US008087667B2

(12) United States Patent
Sekigawa

(10) Patent No.: US 8,087,667 B2
(45) Date of Patent: Jan. 3, 2012

(54) SHEET PROCESSING APPARATUS AND IMAGE FORMING APPARATUS

(75) Inventor: Akito Sekigawa, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/691,975

(22) Filed: Jan. 22, 2010

(65) Prior Publication Data

US 2010/0194037 A1 Aug. 5, 2010

(30) Foreign Application Priority Data

Jan. 30, 2009 (JP) ..... 2009-020828
Jan. 20, 2010 (JP) ..... 2010-009863

(51) Int. Cl.
*B65H 39/02* (2006.01)

(52) U.S. Cl. ..... 271/220; 271/221; 271/223; 271/58.08; 271/58.12

(58) Field of Classification Search ..... 271/220, 271/221, 223; 270/58.08, 58.12
See application file for complete search history.

(56) References Cited

U.S. PATENT DOCUMENTS 6,276,677 B1 8/2001 Hommochi et al. ..... 270/32
6,644,654 B1 * 11/2003 Mao ..... 271/220
7,883,086 B2 * 2/2011 Kamiya ..... 271/220
7,893,338 B2 * 2/2011 Chew ..... 84/609

* cited by examiner

*Primary Examiner* — Kaitlin Joerger
(74) *Attorney, Agent, or Firm* — Fitzpatrick, Cella, Harper & Scinto

(57) ABSTRACT

A sheet processing apparatus according to the invention includes a conveying portion that conveys a sheet; and an abutment member against which an end of the sheet in a conveying direction abuts, the sheet being conveyed by the conveying portion. Herein, the abutment member is movable so as to change a distance between the abutment member and the conveying portion adjacent to the abutment member based on sheet information about the stiffness of a sheet, when an end of the sheet in the conveying direction is abutted against the abutment member.

20 Claims, 19 Drawing Sheets

SHEET PROCESSING APPARATUS AND IMAGE FORMING APPARATUS

BACKGROUND OF THE INVENTION

1. Field of the Invention

The present invention relates to a sheet processing apparatus that processes a sheet bundle formed of a plurality of sheets, and an image forming apparatus that includes the sheet processing apparatus.

2. Description of the Related Art

In the past, as an image forming apparatus for forming an image on a sheet, there is an image forming apparatus where a sheet processing apparatus is provided in an apparatus main body for forming an image on a sheet.

As a sheet processing apparatus, there is a sheet processing apparatus that has a function to bind a sheet bundle in the form of a booklet (see U.S. Pat. No. 6,276,677). As illustrated in FIG. 18, the sheet processing apparatus feeds sheets, which are fed from an apparatus main body 900A of an image forming apparatus, to a gap between a driver 18 of a stapler 40 that protrudes a staple and an anvil 19 that bends the staple, one by one. Then, an end stopper 23 receives the sheet. The end stopper 23 waits at a position where a portion to be bound (generally, a middle portion in a longitudinal direction) of the sheet may face the stapler.

A sheet is nipped between conveying rollers 17*a* and 22*a* and leaf springs 17*d* and 22*d* that press the sheet against the conveying rollers 17*a* and 22*a*, and is conveyed by the rotation of the conveying rollers 17*a* and 22*a*. When a predetermined number of sheets are received by the end stopper 23 and form the shape of a bundle, the bundle is bound by the stapler 40. After that, the end stopper 23 is lowered while receiving the lower end of the bound sheet bundle, and the bound portion of the sheet bundle faces a protruding plate 25*a*. After that, the protruding plate 25*a* pushes the sheet bundle and tucks the sheet bundle into a nip between a pair of folding rollers 26 and 27. The pair of folding rollers 26 and 27 conveys the sheet bundle while folding the sheet bundle, and discharges the sheet bundle to a tray 32. The discharged sheet bundle is formed in the shape of a booklet.

However, in a sheet processing apparatus 2 in the related art, unless an end stopper 23 reliably receives sheets which are fed in a vertical direction, the ends of the sheets are not aligned. For this reason, the sheet is made to bump into the end stopper 23 by the conveying forces of the conveying rollers 17*a* and 22*a*. Meanwhile, the conveying forces are determined depending on the elastic forces of the leaf springs 17*d* and 22*d* that press the sheet against the pair of folding rollers 26 and 27 and the conveying rollers 17*a* and 22*a*. If the elastic force is increased, the conveying force is increased.

For this reason, even though the elastic force is adjusted so that an appropriate conveying force is obtained, as illustrated in FIG. 19, a thin sheet or a sheet S longer than the distance X between the conveying roller 22*a* and the end stopper 23 has been bent and buckled while bumping into the end stopper 23.

There is a concern that the sheet processing apparatus in the related art may process a sheet having low stiffness, a thin sheet, or a sheet longer than the distance between the stapler 40 and the end stopper 23 while buckling occurs as described above. For this reason, the sheet processing apparatus in the related art has been subject to the limitation of the length, thickness, and stiffness of a sheet to be processed.

Further, an image forming apparatus, which includes the sheet processing apparatus in the related art in the apparatus main body thereof, should form images on sheets again as much as sheets that are processed while buckling occurs. For this reason, image forming efficiency is low.

The invention provides a sheet processing apparatus that suppresses buckling occurring on a sheet to be processed, and processes a sheet without having the limitation of the length, thickness, and stiffness of a sheet to be processed.

The invention provides an image forming apparatus including a sheet processing apparatus, which processes a sheet while suppressing buckling occurring on a sheet, and suppresses the forming of images again.

SUMMARY OF THE INVENTION

A sheet processing apparatus according to the present invention includes: a conveying portion that conveys a sheet; and an abutment member against which an end of the sheet conveyed by the conveying portion in a conveying direction abuts, wherein the abutment member is moved so as to reduce a distance between the abutment member and the conveying portion adjacent to the abutment, based on sheet information that stiffness of a sheet is lower than a predetermined stiffness. Accordingly, even though the stiffness of a sheet is low, buckling hardly occurs.

A sheet processing apparatus according to the present invention includes: a conveying portion that conveys a sheet; an abutment member against which an end of the sheet conveyed by the conveying portion in a conveying direction abuts, the sheet being conveyed by the conveying portion; and a processing portion that processes the sheet of which an end in the conveying direction is abutted against the abutment member, wherein the abutment member is selectively movable to one of first and second positions, the first position corresponds to a processing position of the processing portion, and a distance between the abutment member and the conveying portion adjacent to the abutment member is short at the second position in comparison with the first position, and the abutment member is moved to the second position, based on sheet information that stiffness of a sheet is lower than a predetermined stiffness. Accordingly, the sheet processing apparatus according to the invention may receive the lower end of the sheet, which is conveyed by the conveying portion, at a position that is separated from the conveying portion by a predetermined distance and is previously set so that buckling does not occur.

For this reason, the sheet processing apparatus according to the invention may receive a sheet while suppressing buckling even though the sheet is easily buckled and is difficult to be aligned, and may improve the alignment property of the lower end of a sheet.

The image forming apparatus according to the invention includes a sheet processing apparatus that processes a sheet while suppressing buckling. Accordingly, images do not need to be formed again on sheets as much as sheets that become unavailable due to buckling. As a result, it is possible to improve image forming efficiency.

Further features of the present invention will become apparent from the following description of exemplary embodiments with reference to the attached drawings.

DESCRIPTION OF THE EMBODIMENTS

Embodiments of the invention will be described below with reference to the drawings.

(Image Forming Apparatus)

Figure 2:
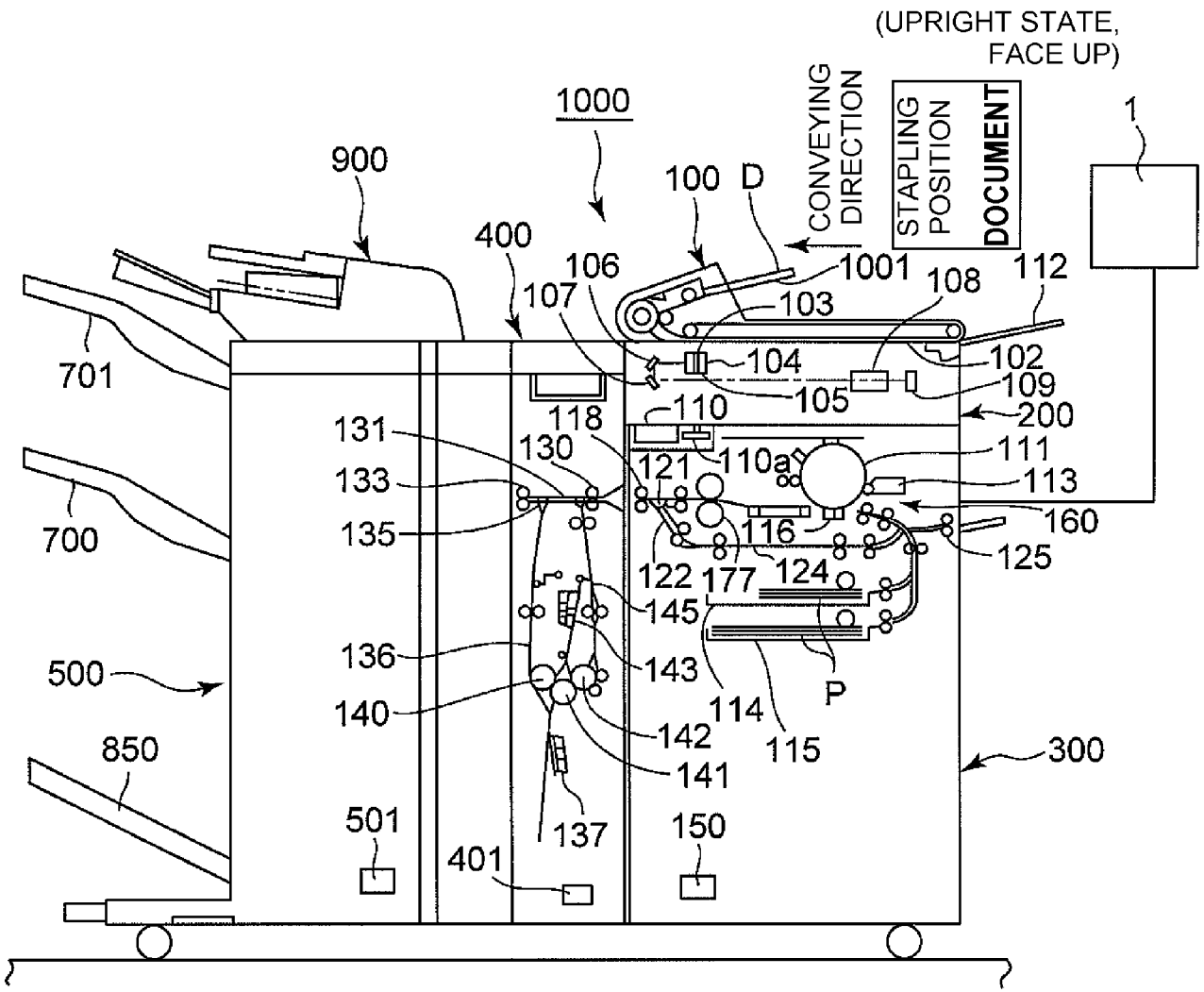
FIG. 2 is a cross-sectional view of an image forming apparatus according to an embodiment of the invention, taken along a sheet conveying direction.

FIG. 2 is a cross-sectional view of an image forming apparatus according to an embodiment of the invention, taken along a sheet conveying direction. As illustrated in FIG. 2, a copying machine 1000 as an image forming apparatus includes a document feeding portion 100, an image reader portion 200, a printer portion 300, a fold processing portion 400, a finisher 500, and an inserter 900.

The image forming apparatus is a copying machine. However, the image forming apparatus is not limited to the copying machine, and may be, for example, another image forming apparatus, such as a scanner, a printer, or a facsimile, or another image forming apparatus such as a combined machine that has the combination of the above functions. The printer portion 300 also functions as an apparatus main body of the image forming apparatus. The fold processing portion 400 and the inserter 900 are optionally provided. Further, the finisher 500 may be integrally assembled in the printer portion 300

Documents D are set on a tray 1001 of the document feeding portion 100 in a face-up state (a state where a surface on which an image is formed faces up). A binding position of the document is the left end portion of the document. The documents set on the tray 1001 are sequentially conveyed one by one from the leading page to the left side, that is, while the binding position is set to the leading position, by the document feeding portion 100. Further, the document passes through a curved path, is conveyed from the left side to the right side on a platen glass 102, and is then discharged onto a discharge tray 112. In this case, a scanner unit 104 is stopped at a predetermined document reading position.

The scanner unit 104 reads an image of the document that passes on the scanner unit 104 from the left side to the right side. A method of reading the document as described above is referred to as "skimming". When the document passes on the platen glass 102, the document is irradiated by a lamp 103 of the scanner unit 104. Light reflected from the document is guided to an image sensor 109 by mirrors 105, 106, and 107 and a lens 108.

Meanwhile, the image reader portion 200 stops the document on the platen glass 102 by the document feeding portion 100, and may read the document while moving the scanner unit 104 from the left side to the right side in this state. This method of reading the document is referred to as "fixed reading". When a document is read without using the document feeding portion 100, a user opens and closes the document feeding portion 100 and sets a document on the platen glass 102. After that, the scanner unit 104 performs the fixed reading of the document. Since the image reader portion 200 reads the document that is set on the platen glass 102 by the user, the document feeding portion 100 is not necessarily required.

The image data of the document, which is read by the image sensor 109, is subject to a predetermined image process and is sent to an exposure controlling portion 110. The exposure controlling portion 110 outputs laser light that corresponds to an image signal. While scanning a polygon mirror 110*a*, the laser light is irradiated to the photosensitive drum 111. An electrostatic latent image corresponding to the laser light, which is irradiated to the photosensitive drum 111, is formed on the photosensitive drum 111. The electrostatic latent image formed on the photosensitive drum 111 is developed by a development device 113, and is visualized as a toner image.

Meanwhile, a sheet (recording sheet) P is conveyed to a transfer portion 116 from any one of cassettes 114 and 115, a manual feeding portion 125, and a duplex conveying path 124. Further, the visualized toner image is transferred to a sheet from the photosensitive drum 111 in the transfer portion 116. The toner image transferred to the sheet is fixed by a fixing portion 177. The photosensitive drum 111 and the development device 113 constitute an image forming portion 160.

Furthermore, the sheet, which has passed through the fixing portion 177, is guided once to a path 122 by a switching member 121. When the rear end of the sheet goes through the switching member 121, the sheet is switch-back conveyed and guided to discharge rollers 118 by the switching member 121. The sheet is discharged to the printer portion 300 by the discharge rollers 118. Accordingly, the sheet is discharged from the printer portion 300 in a state where the surface on which the toner image has been formed faces down (face-down state). These operations are referred to as "reverse discharge".

If sheets are discharged to the outside of the apparatus in the face-down state, an image forming process may be sequentially performed from the leading page. For example, when an image forming process is performed using the document feeding portion 100 or when an image forming process is performed on image data sent from a computer or a facsimile, it is possible to sort the order of pages. Since the copying machine 1000 may receive image data from a computer or a facsimile and form an image on a sheet, the image reader portion 200 is not necessarily required.

Further, when images are formed on both surfaces of the sheet, the printer portion 300 directly guides a sheet to the discharge rollers 118 from the fixing portion 177. Immediately after the rear end of the sheet goes through the switching member 121, the sheet is switch-back conveyed and guided to the duplex conveying path 124 by the switching member 121.

(Fold Processing Portion 400)

Figure 1:
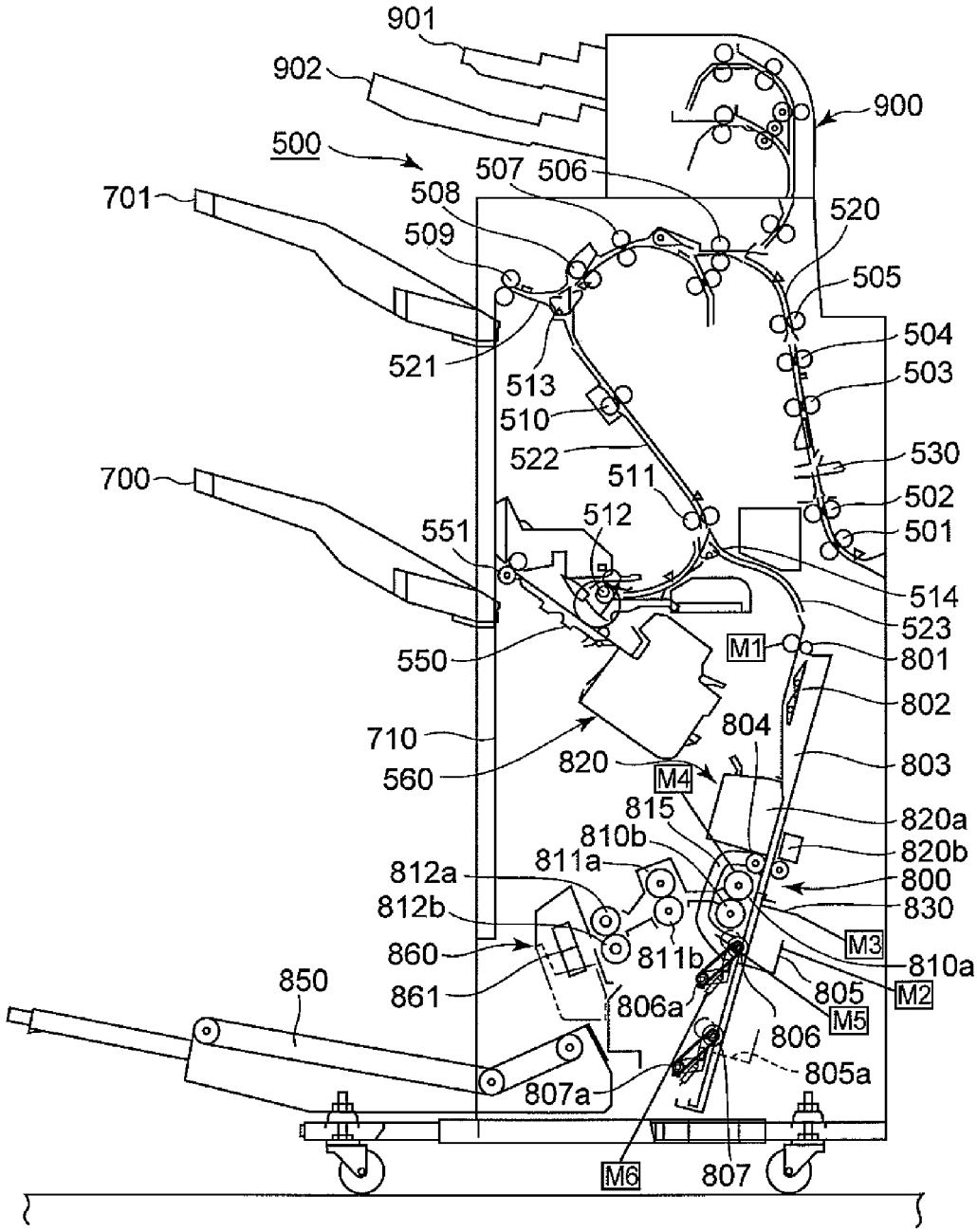
FIG. 1 is a cross-sectional view of a finisher as a sheet processing apparatus according to an embodiment of the invention, taken along a sheet conveying direction.

The configuration of the fold processing portion 400 and the finisher 500 will be described below reference to FIGS. 1 and 2. FIG. 1 is a cross-sectional view of the finisher 500 as a sheet processing apparatus according to an embodiment of the invention, taken along a sheet conveying direction.

In FIG. 2, the fold processing portion 400 includes a conveying path 131 that receives a sheet discharged from the printer portion 300 and guides the sheet to the finisher 500. A pair of conveying rollers 130 and a pair of discharge rollers 133 are provided on the conveying path 131. Further, a switching member 135 provided near the pair of discharge rollers 133 guides the sheet, which is conveyed by the pair of conveying rollers 130, to a folding path 136 or the finisher 500.

When a folding process for folding a sheet is performed, the switching member 135 is switched to the folding path 136 and guides the sheet to the folding path 136. The front end of the sheet conveyed to the folding path 136 bumps into a stopper 137, so that a loop is formed. Then, the sheet is folded by the folding rollers 140 and 141. A loop, which is formed by the folded portion bumping into an upper stopper 143, is further folded by folding rollers 141 and 142, so that the sheet is Z-folded. The Z-folded sheet is guided along conveying paths 145 and 131, and is discharged to the finisher 500 by the pair of discharge rollers 133. Meanwhile, a fold processing operation of the fold processing portion 400 is selectively performed.

When a folding process is not performed, the switching member 135 is switched so as to guide the sheet to the finisher 500. The sheet discharged from the printer portion 300 passes through the conveying path 131 and the switching member 135, and is directly fed to the finisher 500.

(Finisher 500)

FIG. 1 is a cross-sectional view of the finisher 500 as a sheet processing apparatus according to an embodiment of the invention, taken along a sheet conveying direction.

The finisher 500 aligns a plurality of sheets, which is conveyed from the printer portion 300 through the fold processing portion 400, and performs the process for the sheets. The process for the sheets includes a process for binding sheets into one sheet bundle, a stapling process (binding process) for stapling the rear end of the sheet bundle, a sorting process, a non-sorting process, and the like.

As illustrated in FIG. 1, the finisher 500 includes a conveying path 520 that takes the sheet, which is conveyed through the fold processing portion 400, into the apparatus. Pairs of conveying rollers 502 to 508 are sequentially provided on the conveying path 520 from a pair of entrance rollers 501 toward the downstream side in the sheet conveying direction.

A punch unit 530 is provided between the pair of conveying rollers 502 and the pair of conveying rollers 503. The punch unit 530 punches (performs a punching process on) the rear end portion of the sheet to be conveyed, as necessary.

A switching member 513, which is provided at the end of the conveying path 520, switches a path to a lower discharge path 522 and an upper discharge path 521 connected to the downstream side. The upper discharge path 521 guides sheets to a sample tray 701 by an upper discharge roller 509. Meanwhile, pairs of conveying rollers 510, 511, and 512 are provided on the lower discharge path 522. These pairs of conveying rollers 510, 511, and 512 convey and discharge sheets to a processing tray 550.

The sheets discharged to the processing tray 550 are stacked in the form of a bundle while being sequentially aligned, and a sorting process or a stapling process is performed on the sheets according to the setting by the operation portion 1 (FIG. 2). The processed sheet bundle is selectively discharged to a stack tray 700 and a sample tray 701 by a pair of bundle discharge rollers 551.

Meanwhile, a stapling process is performed by a stapler 560. The stapler 560 moves sheets in a width direction of the sheet (in a direction crossing the sheet conveying direction), and binds an arbitrary portion of the sheet bundle. The stack tray 700 and the sample tray 701 are lifted and lowered along an apparatus main body of the finisher 500. The upper sample tray 701 receives a sheet from the upper discharge path 521 and the processing tray 550. Further, the lower stack tray 700 receives a sheet from the processing tray 550. In this way, a large number of sheets are stacked in the stack tray 700 and the sample tray 701. The rear ends of the stacked sheets are received and aligned by a rear end guide 710 that extends in a vertical direction.

A switching member 514 is provided on the lower discharge path 522. The switching member 514 guides a sheet to the processing tray 550 or a saddle discharge path 523. The sheet, which is guided to the saddle discharge path 523 by the switching member 514, is fed to a saddle stitching binding portion 800.

(Saddle Stitching Binding Portion 800)

The configuration of the saddle stitching binding portion 800 will be described below.

The sheet fed to the saddle stitching binding portion 800 is transferred to a pair of saddle entrance rollers 801. Then, a feed-in port is selected by a switching member 802, which is operated by a solenoid, according to size, and the sheet is fed into a storage guide 803 as a guide member that guides a sheet in a longitudinal direction. The storage guide 803 is inclined so that the downstream portion of the storage guide in the sheet conveying direction is lower than the upstream portion thereof and a sheet can be stacked on the storage guide. The fed sheet continues to be conveyed by a sliding roller 804, and is transferred to upper and lower feed rollers 806 and 807 as a plurality of rotating bodies that is provided on the downstream side and constitutes a conveying portion for conveying a sheet along the storage guide 803 toward the lower side.

The sliding roller 804 is a roller having slidability. The upper and lower feed rollers 806 and 807 also have slidability like the sliding roller 804. The upper and lower feed rollers 806 and 807 are swung about fulcrum shafts 806*a* and 807*a* to a position (position illustrated by a solid line in FIG. 1) where the feed rollers abut against a sheet and a retraction position (position illustrated by a broken line) where the feed rollers are separated from a sheet, by solenoids 816*a* and 816*b* (FIG. 3).

Figure 3:
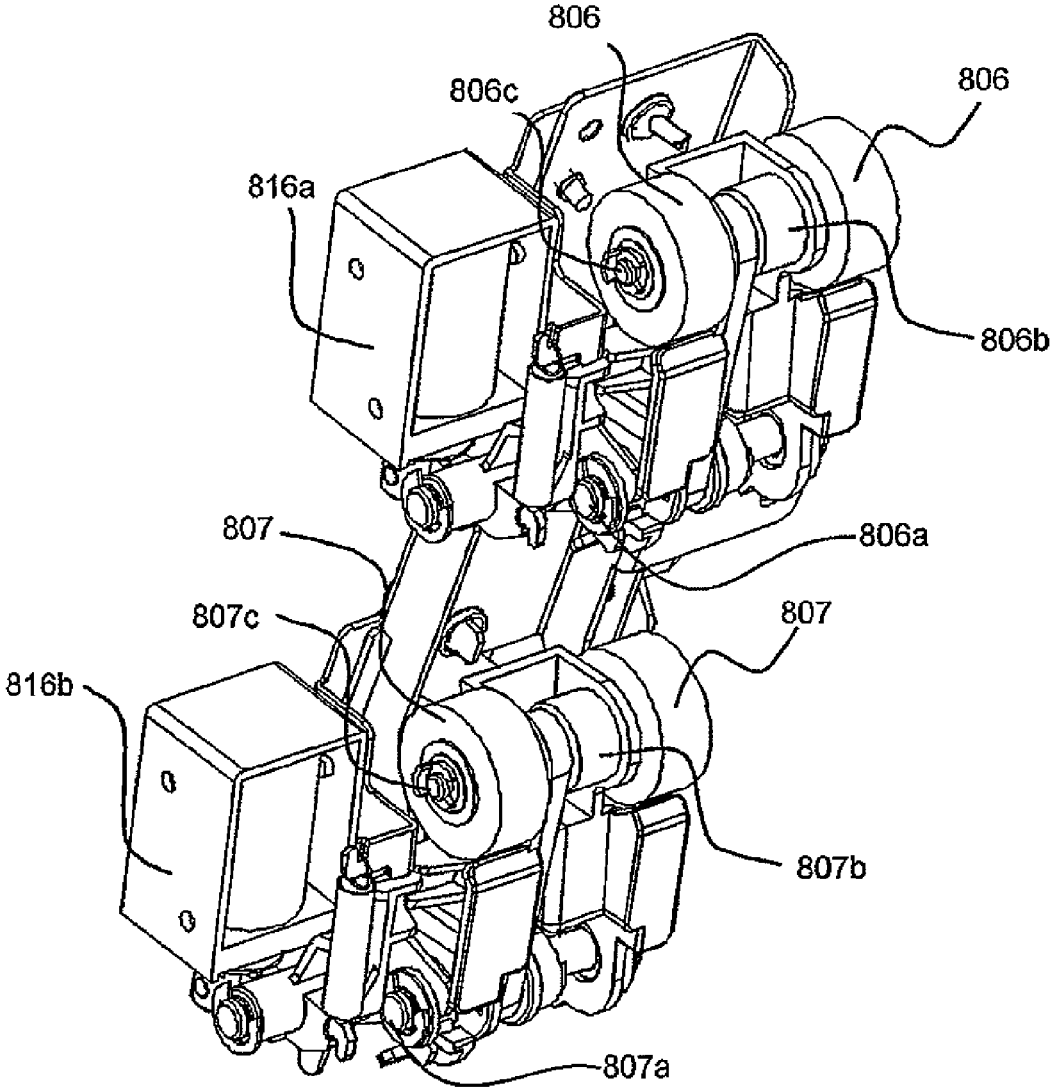
FIG. 3 is a perspective view of upper and lower rollers.

As illustrated in FIG. 3, a fulcrum shaft 806*c* of the upper feed roller 806 and a fulcrum shaft 807*c* of the lower feed roller 807 are provided with one-way clutch gears 806*b* and 807*b* so that the rollers 806 and 807 are rotated so as to lower a sheet bundle. The pair of saddle entrance rollers 801 and the sliding roller 804 are rotated by an entrance roller motor M1 (FIG. 1). Further, the upper and lower feed rollers 806 and 807 are rotated by a feed roller motor M6 (FIG. 1).

As described below, the sheet conveyed to the storage guide 803 is conveyed until the end of the sheet (the downstream end of the sheet in the conveying direction, the lower end, or the front end) abuts against the end stopper 805 that is previously moved to a predetermined position according to the size of the sheet (the length of the sheet in the conveying direction).

The end stopper 805 may be moved (may be lifted and lowered) in the sheet conveying direction by an end stopper moving motor M2 (FIG. 1) along a sheet guide surface that is inclined so that the downstream portion of the storage guide 803 in the sheet conveying direction is lower than the upstream portion thereof. Further, the end stopper 805 (FIG. 4) includes a regulation surface 805*a* that is protruded from the storage guide 803. The regulation surface 805*a* of the end stopper 805 receives the downstream end portion of the sheet, which is conveyed to the storage guide 803 by the upper or lower feed roller 806 or 807, in the conveying direction.

Figure 7:
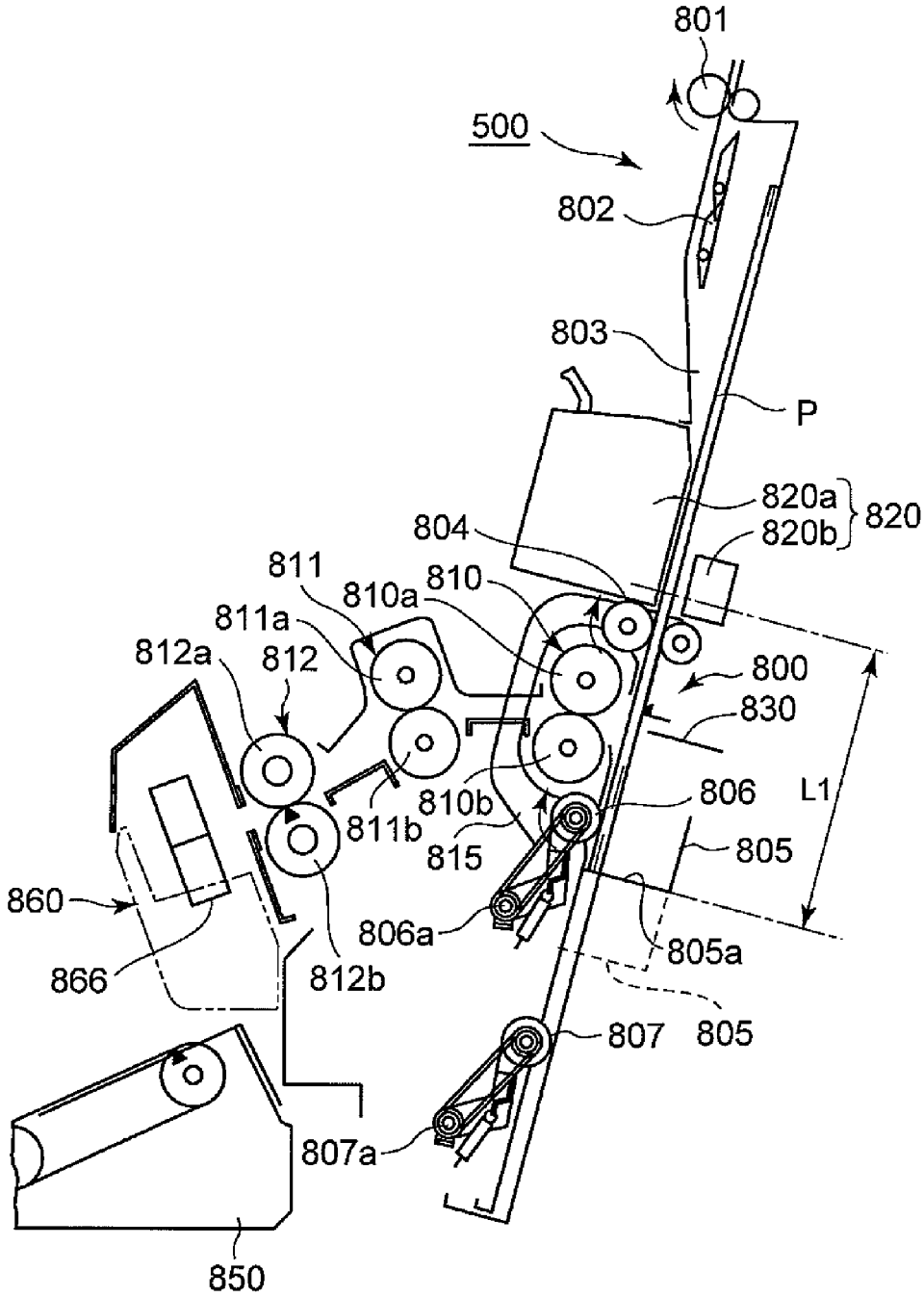
FIG. 7 is a view illustrating that the end stopper receives a sheet near the upper feed roller.
Figure 8:
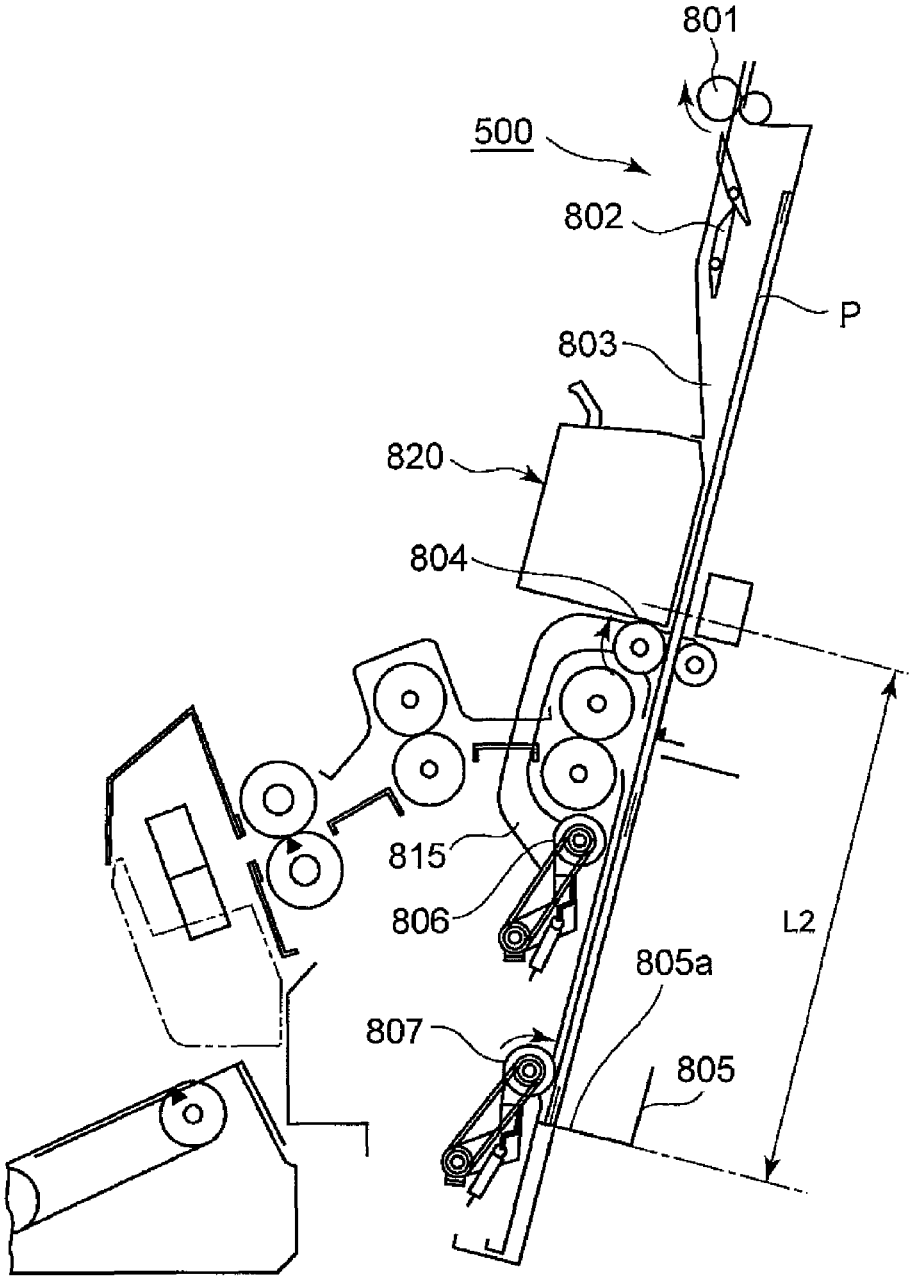
FIG. 8 is a view illustrating that the end stopper receives a sheet near the lower feed roller.

The end stopper 805 receives a sheet at an upper receiving position of FIG. 7 or a lower receiving position of FIG. 8, which is separated from the upper or lower feed roller by a predetermined distance on the downstream side of the upper or lower feed roller 806 or 807.

That is, an upper receiving position (second position) of the end stopper 805 as an abutment member is a position illustrated by a solid line in FIG. 1, and is a downstream receiving position that is separated from the adjacent upper feed roller 806 by a predetermined distance so that a sheet is not buckled. Further, a lower receiving position (second position) of the end stopper 805 is a position illustrated by a broken line in FIG. 1, and is a downstream receiving position that is separated from the adjacent lower feed roller 807 by the same distance as the predetermined distance.

Since the buckling (deflection) of a sheet is apt to occur in proportion to the length of a sheet in the conveying direction, it is preferable that the receiving position of the end stopper 805 be set to a position where the predetermined distance is short. In addition, the predetermined distance varies depending on the stiffness (grammage) of a sheet or the conveying force of the feed roller, but set in the range of about 15 to 30 mm. Meanwhile, this value is determined by experiments and the like, and is not limited thereto.

If the sheet, which is stored ahead, is buckled, the feed path of a sheet to be stored next is blocked, which causes a sheet jam. Accordingly, the predetermined distance is set in a range where a sheet jam is not generated (a range where a sheet is not buckled). That is, the predetermined distance is a distance where a sheet is not buckled even though the sheet receives some conveying force of the feed rollers 806 and 807 after bumping into the regulation surface 805*a*.

Figure 4:
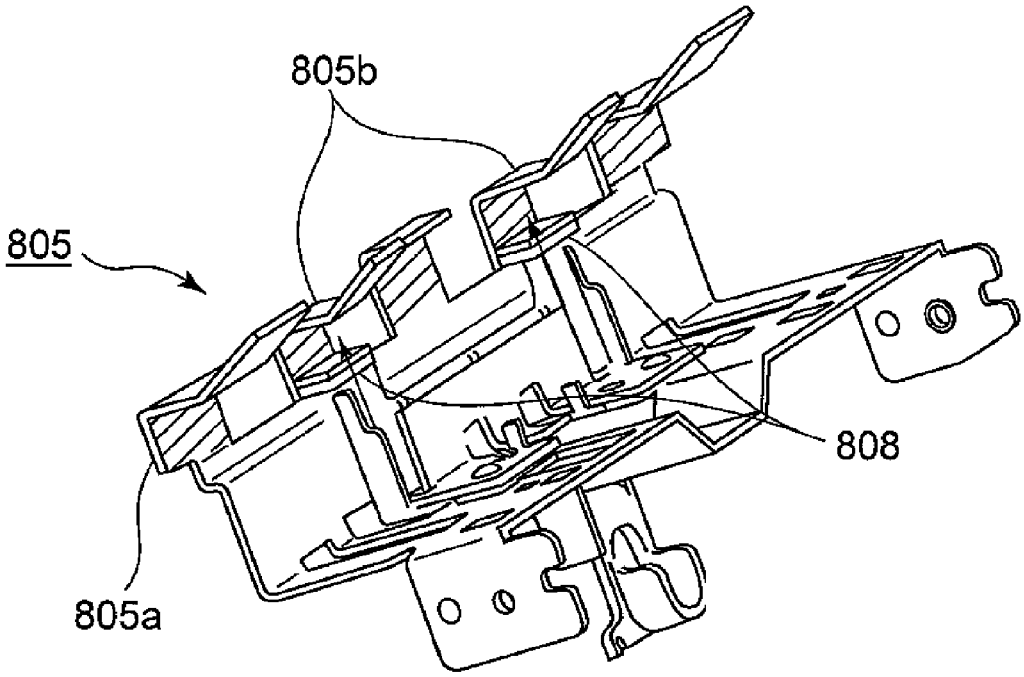
FIG. 4 is a perspective view of an end stopper.

As illustrated in FIG. 4, a guide surface 805*b*, which is bent from the regulation surface 805*a*, is formed at the end stopper 805 so as to face the sheet guide surface of the storage guide 803. In addition, the end stopper 805 includes a holding member 808 that is moved in a direction of an arrow along the regulation surface 805*a* by a solenoid (not illustrated). The holding member 808 is a member that grips the sheet bundle, which is stored in the storage guide 803 and bumps into the end stopper 805, in cooperation with the guide surface 805*b* so as to hold the sheet bundle. That is, the end stopper 805 functions as a grip part that is moved while gripping (holding) the sheet bundle in cooperation with the holding member 808. Accordingly, the end stopper 805 lifts and lowers the sheet bundles without disturbing the stored sheet bundles, making it possible to convey the sheet bundle so that the processing position on the sheet bundle is positioned at the processing position (the binding position or the folding position). Further, the end stopper 805 and the holding member 808 may prevent the deflection or buckling of the sheet bundle by gripping the sheet bundle.

A stapler 820 facing the storage guide 803 is provided on the storage guide 803 of FIG. 1. The stapler 820 is a device for binding the middle portion (processing position) of the sheet bundle, which is stored in the storage guide 803, in the conveying direction. The stapler 820 includes a driver 820*a* for protruding a staple and an anvil 820*b* for bending the protruded staple, and staples the middle portions of the sheets, which are received by the end stopper 805 and form a bundle, in the conveying direction.

Accordingly, in terms of the reduction of processing time or the stability of the conveyance of bundles, it is preferable that the sheet storing position be close to a stapling position.

A pair of folding rollers 810*a* and 810*b* and a protruding member 830 are provided on the downstream side of the stapler 820 of FIG. 1 so as to face each other with the storage guide 803 therebetween. The pair of folding rollers 810*a* and 810*b* and the protruding member 830 form a folding device for folding the sheet bundle, which is stored in the storage guide 803, in two at the middle portion of the sheet bundle in the conveying direction. The protruding member 830 is protruded by a thrust motor M3 from a home position, which is separated from the storage guide 803, toward the middle portion of the sheet bundle, which is stored in the storage guide, in the conveying direction. Accordingly, the protruding member tucks the sheet bundle into a nip between the pair of folding rollers 810*a* and 810*b*. The protruding member 830 protrudes the sheet bundle and then returns to the home position again. Meanwhile, pressure F1, which is enough to make a folding line on the sheet bundle, is applied to the pair of folding rollers 810*a* and 810*b* by springs (not illustrated).

The sheet bundle, which has a folding line made by being tucked into the nip between the pair of folding rollers 810*a* and 810*b*, is conveyed to a pair of first folding conveyance rollers 811 (811*a* and 811*b*) and a pair of second folding conveyance rollers 812 (812*a* and 812*b*) and is then sent to a folding line pressing unit 860. Pressures F2 and F3, which are enough to convey and stop the sheet bundle having a folding line, are also applied to the pair of first folding conveyance rollers 811 and the pair of second folding conveyance rollers 812, respectively. The pair of folding rollers 810, the pair of first folding conveyance rollers 811, and the pair of second folding conveyance rollers 812 are rotated at a constant speed by the same conveying motor M4 (FIG. 1).

Further, when the sheet bundle is folded without the binding process, the storage guide 803 moves the sheet bundle so that the middle portion of the sheet bundle, which is stored in the storage guide 803, in the conveying direction faces the pair of folding rollers 810*a* and 810*b*. Meanwhile, when the sheet bundle bound by the stapler 820 is folded, the storage guide moves the sheet bundle, which is positioned at the binding position, to the end stopper 805 after the finish of the stapling process so that the binding position on the sheet bundle (the middle portion of the sheet bundle in the conveying direction) faces the nip between the pair of folding rollers 810. Accordingly, the sheet bundle is folded in two about the binding position, thereby being formed in the shape of a booklet.

In this way, by the movement of the end stopper 805, the sheet bundle is moved from each receiving position (sheet storing position) to the binding position, or from the binding position to the folding position. In this case, the end stopper 805 is lowered and lifted by the end stopper moving motor M2 (FIG. 1) and moves (conveys) the sheet bundle while gripping the sheet bundle in cooperation with the guide surface 805*b* of the end stopper 805 and the holding member 808. The holding member 808 generates sufficient grip pressure in cooperation with the guide surface 805*b* without the disturbance of the alignment of the sheet bundle that is being moved. In addition, the sheet bundle, which is moved to the processing position (the binding position or the folding position) by the lowering of the end stopper 805, is pressed against the storage guide 803 by the upper feed roller 806 or the lower feed roller 807. The upper feed roller 806 or the lower feed roller 807 is disposed on the upstream side of the end stopper 805 in the moving direction of the sheet bundle. The disposition thereof will be described below.

Further, a pair of alignment plates 815 including surfaces, which protrude toward the storage guide 803 while covering the outer peripheral surfaces of the pair of folding rollers 810*a* and 810*b*, is provided near the pair of folding rollers 810*a* and 810*b*. The pair of alignment plates 815 is driven by an alignment plate moving motor M5 (FIG. 1) and is moved in a width direction orthogonal to the sheet conveying direction, thereby aligning (positioning) the sheets, which are stored in the storage guide 803, in the width direction of the sheet.

Furthermore, the folding line pressing unit 860, which spatially overlaps the folded bundle discharge tray 850 and presses the folding line of the sheet bundle folded in two, is provided on the downstream side of the pair of second folding conveyance rollers 812. The folding line pressing unit 860 includes a press holder that supports a pair of press rollers 861. The pair of press rollers 861 is moved in the direction of the folding line of the sheet bundle (the width direction orthogonal to the conveying direction) and presses the folding line of the sheet bundle while nipping the folding line of the sheet bundle. Booklets, which have been subject to saddle stitching binding, are collectively stacked on the folded bundle discharge tray 850.

(Inserter)

The inserter 900 illustrated in FIG. 1 will be described below. The inserter 900 is provided above the finisher 500. The inserter 900 is used to insert a sheet (insert sheet) different from an ordinary sheet into the leading page, the last page, or the middle page of the sheets. That is, the inserter 900 is used to insert an insert sheet or a cover sheet between the sheets on which images have been formed in the printer portion 300.

The inserter 900 is used to feed the sheets, which are set on insert trays 901 and 902 by a user, to any one of the stack tray 700, the sample tray 701, and the folded bundle discharge tray 850 without making the sheets pass through the printer portion 300. The sheet bundles, which are stacked on the insert trays 901 and 902, are sequentially separated one by one and fed to the conveying path 520 at a predetermined timing.

(Control Portion)

Figure 5:
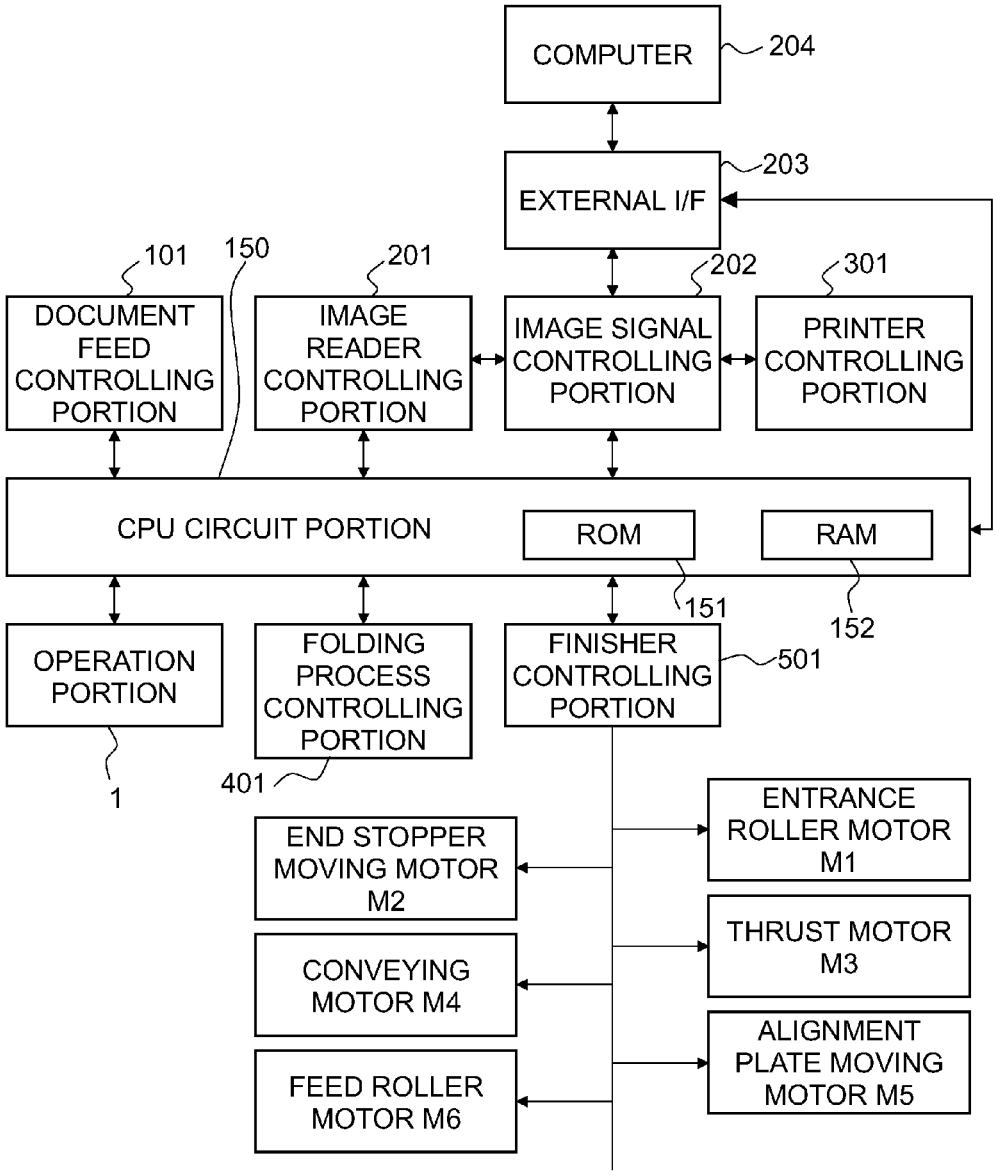
FIG. 5 is a block diagram of a control portion of the image forming apparatus.

FIG. 5 is a block diagram illustrating the configuration of a control system of the copying machine 1000.

A CPU circuit portion 150 is provided in the printer portion 300, and includes a CPU (not illustrated), a ROM 151, and a RAM 152. The CPU circuit portion 150 controls a document feed controlling portion 101, an image reader controlling portion 201, an image signal controlling portion 202, a printer controlling portion 301, and a folding process controlling portion 401, according to the setting of the operation portion 1 and control programs stored in the ROM 151. The CPU circuit portion 150 also controls a finisher controlling portion 501 and an external I/F (external interface) 203. Further, the document feed controlling portion 101 controls the document feeding portion 100, the image reader controlling portion 201 controls the image reader portion 200, the printer controlling portion 301 controls the printer portion 300, and the folding process controlling portion 401 controls the fold processing portion 400.

Further, the finisher controlling portion 501 is mounted on the finisher 500, and controls the finisher 500, the saddle stitching binding portion 800, and the inserter 900. The finisher controlling portion 501 determines whether a sheet is apt to be deflected, based on at least one of sheet information about rigidity (stiffness), which is sent from the CPU circuit portion 150, such as the grammage, and thickness of the sheet. Then, the finisher controlling portion 501 controls the finisher 500. In addition, whether a sheet is apt to be deflected is determined, based on a result of a comparison between the receiving sheet information about stiffness and a predetermined rigidity (stiffness) stored in the finisher controlling portion 501. Meanwhile, whether a sheet is apt to be deflected may be determined by the CPU circuit portion 150, and the finisher controlling portion 501 may control the finisher 500 based on the determination result of the CPU circuit portion. The driving of each of the motors M1 to M6 of the saddle stitching binding portion 800 is controlled by the finisher controlling portion 501. The operation portion 1 includes a plurality of keys (not illustrated) that is used to set various functions related to the formation of an image, and display parts that display the setting conditions of the keys. The operation portion 1 outputs a key signal, which corresponds to the user's operation of each key, to the CPU circuit portion 150, and displays corresponding information on the display parts based on the signal output from the CPU circuit portion 150.

The RAM 152 is used as an area where control data is temporarily stored, or a work area for calculation that is accompanied with control. The external I/F 203 is an interface between the copying machine 1000 and an external computer 204, deploys print data, which is output from the computer 204, to a bitmap image, and outputs the print data to the image signal controlling portion 202 as image data. Further, the image of the document, which is read by the image sensor 109, is output to the image signal controlling portion 202 from the image reader controlling portion 201. The printer controlling portion 301 outputs image data, which is output from the image signal controlling portion 202, to the exposure controlling portion 110.

The finisher controlling portion 501 is mounted on the finisher 500. However, the finisher controlling portion may be provided in the printer portion 300 so as to be integrated with the CPU circuit portion 150, and may control the finisher 500 from the printer portion 300.

(Operation of Saddle Stitching Binding Portion 800)

Figure 6:
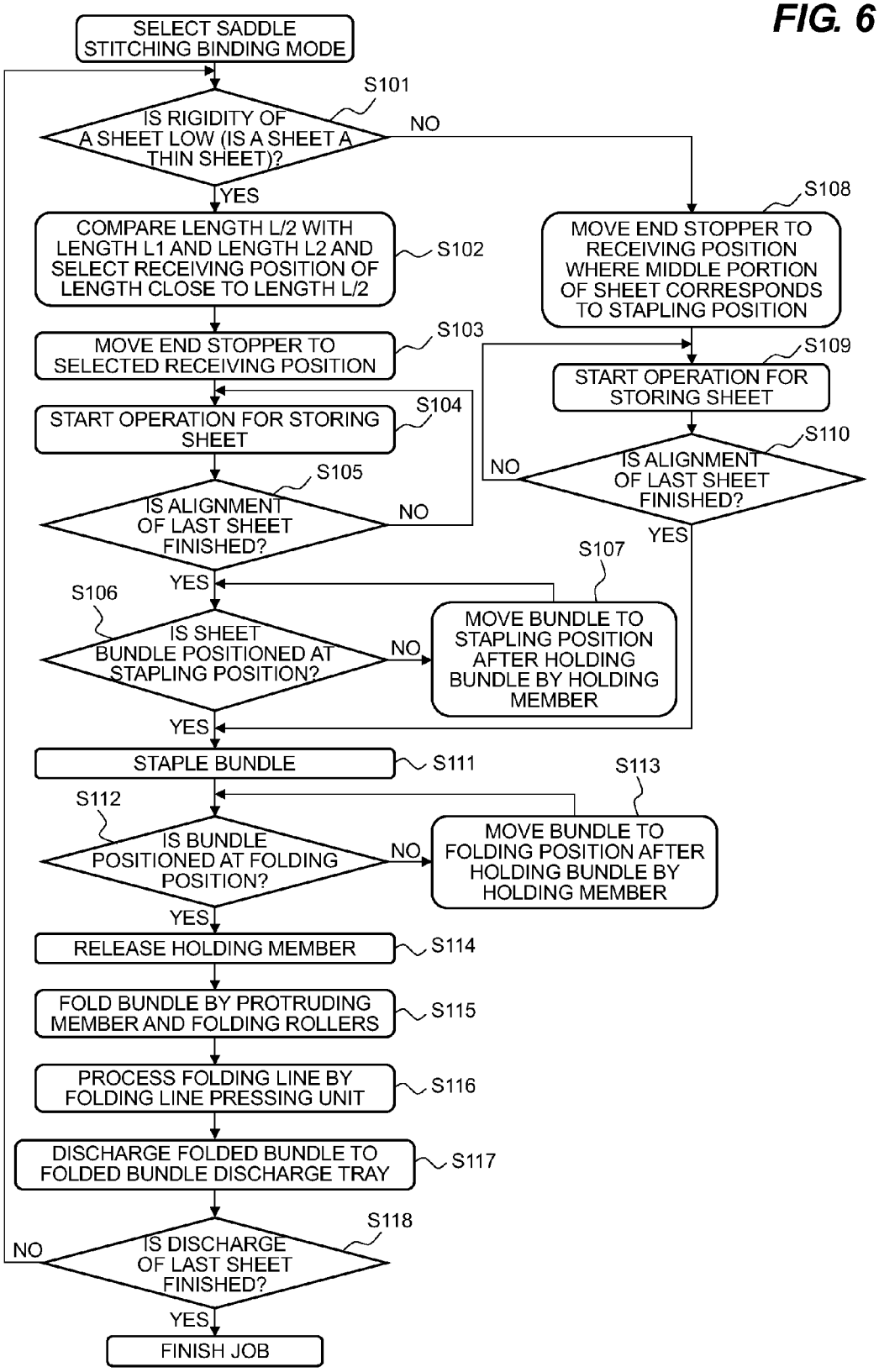
FIG. 6 is a flowchart illustrating the operation of a saddle stitching binding portion.

The operation of the saddle stitching binding portion 800 and a sheet flow will be described below with reference to FIGS. 6 to 12. FIG. 6 is a flowchart illustrating the operation of the saddle stitching binding portion. FIGS. 7 to 12 are views illustrating the operation of the saddle stitching binding portion.

When a saddle stitching binding mode is set by a user, sheets P on which images have been formed are sequentially discharged from the discharge rollers 118 (FIG. 2) of the printer portion 300. The sheet P passes through the fold processing portion 400, and is transferred to the pair of entrance rollers 501 (FIG. 1). Then, the sheet passes through the conveying path 520 and enters the lower discharge path 522. After that, the sheet P is guided to the saddle discharge path 523 by the switching member 514 that is provided on the lower discharge path 522.

If the sheet receiving position is close to the binding position of the next process as described above, the finisher controlling portion 501 may reduce processing time. For this reason, if the rigidity of a sheet is high (a thick sheet) (NO in S101), the finisher controlling portion sets the sheet receiving position so that the distance between the binding position and the end stopper 805 is equal to half the length L (i.e., L/2) of the sheet P in the conveying direction (S108) (for example, the position illustrated by a broken line in FIG. 7). This position is a first position that corresponds to the binding position (processing position) for the stapler 820. That is, if the thickness of a sheet is equal to or larger than a predetermined thickness, the end stopper 805 receives and accumulates sheets at a position where the middle portion (processing position) of a sheet in the conveying direction may face the stapler 820. In this case, since the length L of a sheet depends on the size of a sheet, the receiving position varies depending on the length of a sheet.

Further, if receiving sheet information of a sheet, which is apt to be deflected, such as a thin sheet having a rigidity (stiffness) lower than a predetermined rigidity (stiffness) (YES in S101), the finisher controlling portion 501 proceeds to S102. That is, if the thickness of a sheet is smaller than a predetermined thickness, it is determined which of the length L1 of FIG. 7 and the length L2 of FIG. 8 is close to half the length L (L/2) of the sheet P in the conveying direction (S102). The length L1 is the distance between the regulation surface 805*a* of the upper receiving position and the binding position. The length L2 is the distance between the regulation surface 805*a* of the lower receiving position and the binding position. Further, the finisher controlling portion 501 selects the receiving position of the end stopper 805 that corresponds to the length close to half the length (L/2) of the sheet (S102). That is, the finisher controlling portion 501 selects an upper receiving position or a lower receiving position that is closer to the receiving position (for example, the position of the end stopper 805 illustrated by a broken line in FIG. 7) set (decided) in S108 based on the length of the sheet.

FIG. 7 is a view illustrating a state where the upper receiving position is selected. The sheet P, which is guided to the saddle discharge path 523 (FIG. 1), is discharged to the storage guide 803 while being guided by the switching member 802 corresponding to the size of the sheet. Further, while receiving the conveying forces of the sliding roller 804 and the upper feed roller 806, the sheet P bumps into the regulation surface 805*a* (see FIG. 4) of the end stopper 805, which is stopped at the upper receiving position, and stops. The distance between the upper feed roller 806 and the end stopper 805 positioned at the upper receiving position is smaller than the distance between the upper feed roller 806 and the end stopper 805 positioned at the first position where the middle portion of the sheet in the conveying direction may face the stapler 820.

Meanwhile, FIG. 8 is a view illustrating a state where the lower receiving position is selected. The sheet P, which is guided to the saddle discharge path 523 (FIG. 1), is discharged to the storage guide 803 while being guided by the switching member 802 corresponding to the size of the sheet. Further, while receiving the conveying forces of the sliding roller 804 and the lower feed roller 807, the sheet P bumps into the regulation surface 805*a* (see FIGS. 4 and 8) of the end stopper 805, which is stopped at the lower receiving position, and stops. The distance between the lower feed roller 807 and the end stopper 805 positioned at the lower receiving position is smaller than the distance between the lower feed roller 807 conveying a sheet and the end stopper 805 positioned at the first position where the middle portion of the sheet in the conveying direction may face the stapler 820.

In this case, the upper feed roller 806 retracts to a position that is separated from the sheet P. Even if the upper receiving position is selected, the lower feed roller 807 may retract to a position that is separated from the sheet P.

In any case, as described above, the distance between the regulation surface 805*a* of the end stopper 805 and the feed roller (806 or 807) corresponding to the receiving position of the end stopper 805 is set in the range where the sheet P is not buckled.

The feed roller 806 (or 807) applies the conveying force of the feed roller to the sheet after making the downstream end of the sheet P in the conveying direction abut against the regulation surface 805*a* of the end stopper 805. However, the feed roller is rotated while sliding, so as to prevent the buckling of the sheet. For this reason, the downstream end of the sheet bumps into the end stopper 805, so that the conveying direction of the sheet is aligned and the sheet is stacked.

Since the subsequent operations are the same regardless of the upper and lower receiving positions, there will be described only a case where the upper receiving position is selected.

Meanwhile, the lower end of the sheet, which corresponds to half the length (L/2) of the sheet, may be positioned between the upper receiving position and the upper feed roller 806 (in the range of a predetermined distance) or between the lower receiving position and the lower feed roller 807 (in the range of a predetermined distance). In this case, the position of the lower end of the sheet is the receiving position regardless of rigidity.

After the end stopper 805 is moved to the selected receiving position as described above (S103), an operation for storing the sheet in the saddle stitching binding portion 800 starts (S104). Further, the downstream end of the sheet bumps into the end stopper 805 that is moved to the receiving position as described above, so that the conveying direction of the sheet is aligned. Subsequently, the pinching and alignment are performed by the pair of alignment plates 815 that has waited at a position having no difficulty in storing the sheet. Accordingly, the alignment is also performed in the width direction orthogonal to the sheet conveying direction. The above-mentioned operations for storing and aligning sheets are performed whenever one sheet P is discharged to the storage guide 803, and are performed until the alignment of the last sheet of one sheet bundle is finished (S105).

Figure 9:
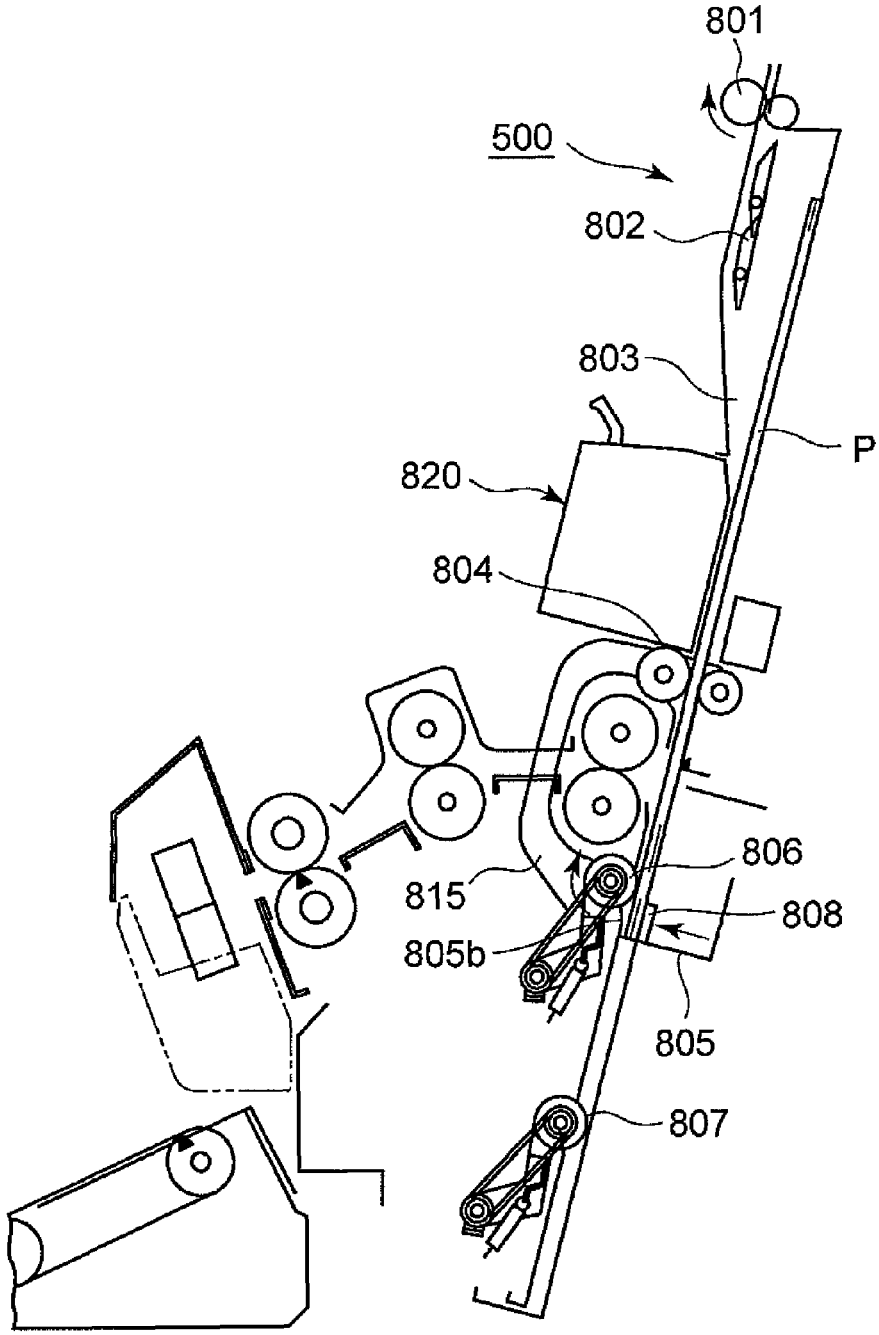
FIG. 9 is a view illustrating that the end stopper grips the lower end of a sheet bundle and lifts and lowers the sheet bundle.

If the alignment of the last sheet is finished (YES in S105), the holding member 808, which has waited outside the sheet feed path, is moved in the direction of the arrow by the solenoid as illustrated in FIG. 9 and grips (holds) the stored sheet bundle P in cooperation with the guide surface 805*b* of the end stopper 805. FIG. 9 is a view illustrating a state where the upper receiving position is selected.

Figure 10:
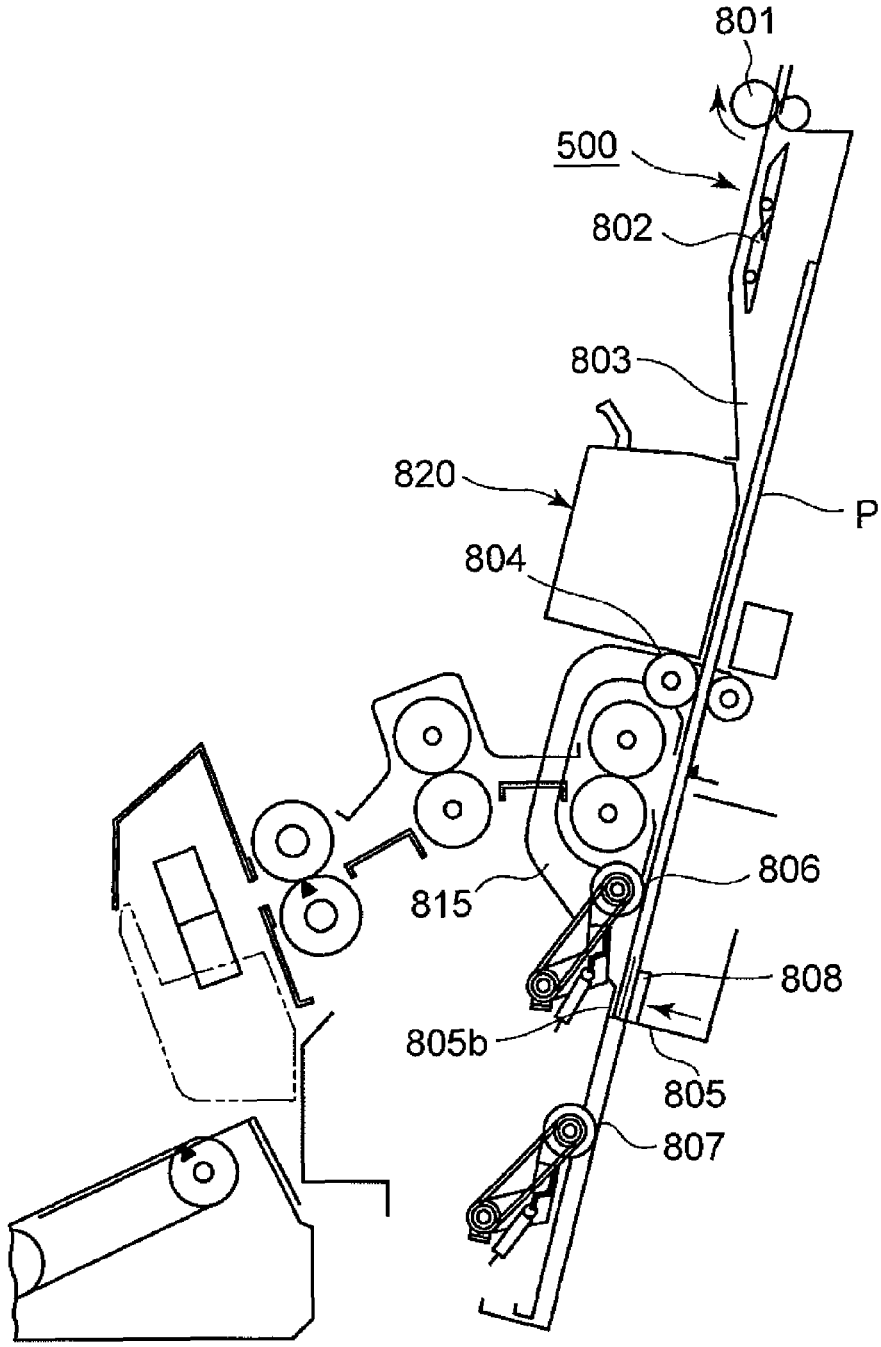
FIG. 10 is a view illustrating that a middle portion of a sheet bundle is at a position of a stapler.

If the rigidity of a sheet is high (a sheet expect for a thin sheet) (NO in S101) when the sheet is stored, the middle portion of the sheet bundle in the conveying direction has been already positioned at the binding position as illustrated in FIG. 10 as described above (S108 to S110). For this reason, the sheet bundle is stapled by the stapler 820 as it is (S111).

Meanwhile, if the rigidity of a sheet is low (a thin sheet) when the sheet is stored, the end stopper 805 is positioned from the feed roller in the range where buckling does not occur. For this reason, the middle portion of the sheet bundle P in the sheet conveying direction does not necessarily correspond to the binding position as illustrated in FIG. 9 (NO in S106). If the sheet bundle P is not positioned at the binding position as described above, the end stopper 805 moves the sheet bundle while gripping (holding) the sheet bundle P by the holding member 808 and the guide surface 805*b*, until the middle portion of the sheet bundle P in the sheet conveying direction corresponds to the binding position (S107). The sheet bundle, which is moved to the binding position (S106), is stapled by the stapler 820 (S111).

Figure 11:
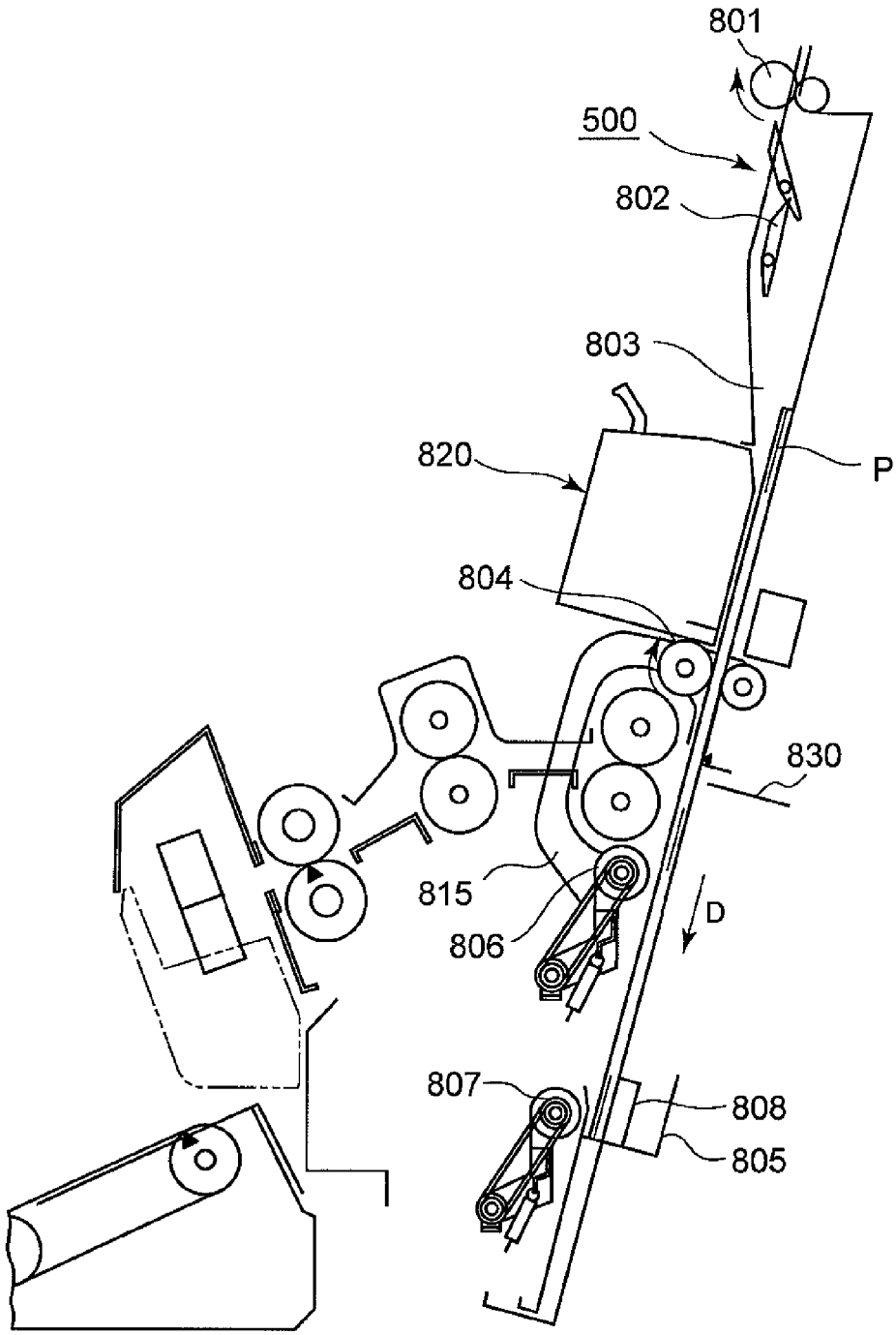
FIG. 11 is a view illustrating that a binding portion of a sheet bundle faces a protruding member.

After that, as illustrated in FIG. 11, the stapled sheet bundle P is moved downward (in a direction of an arrow D) to the folding position by the movement of the end stopper 805 while being held by the holding member 808 (NO in S112, S113). Further, the downward movement of the end stopper 805 is stopped at the folding position where the middle portion (portion to be stapled) of the sheet bundle P faces the nip between the pair of folding rollers 810 (YES in S112). Since the sheet bundle is gripped by the holding member 808 and the guide surface 805*b* during this time, the deflection or buckling of the sheet bundle is prevented. After that, the holding member 808 of the end stopper 805 releases the gripping (holding) of the sheet bundle P (S114).

Figure 12:
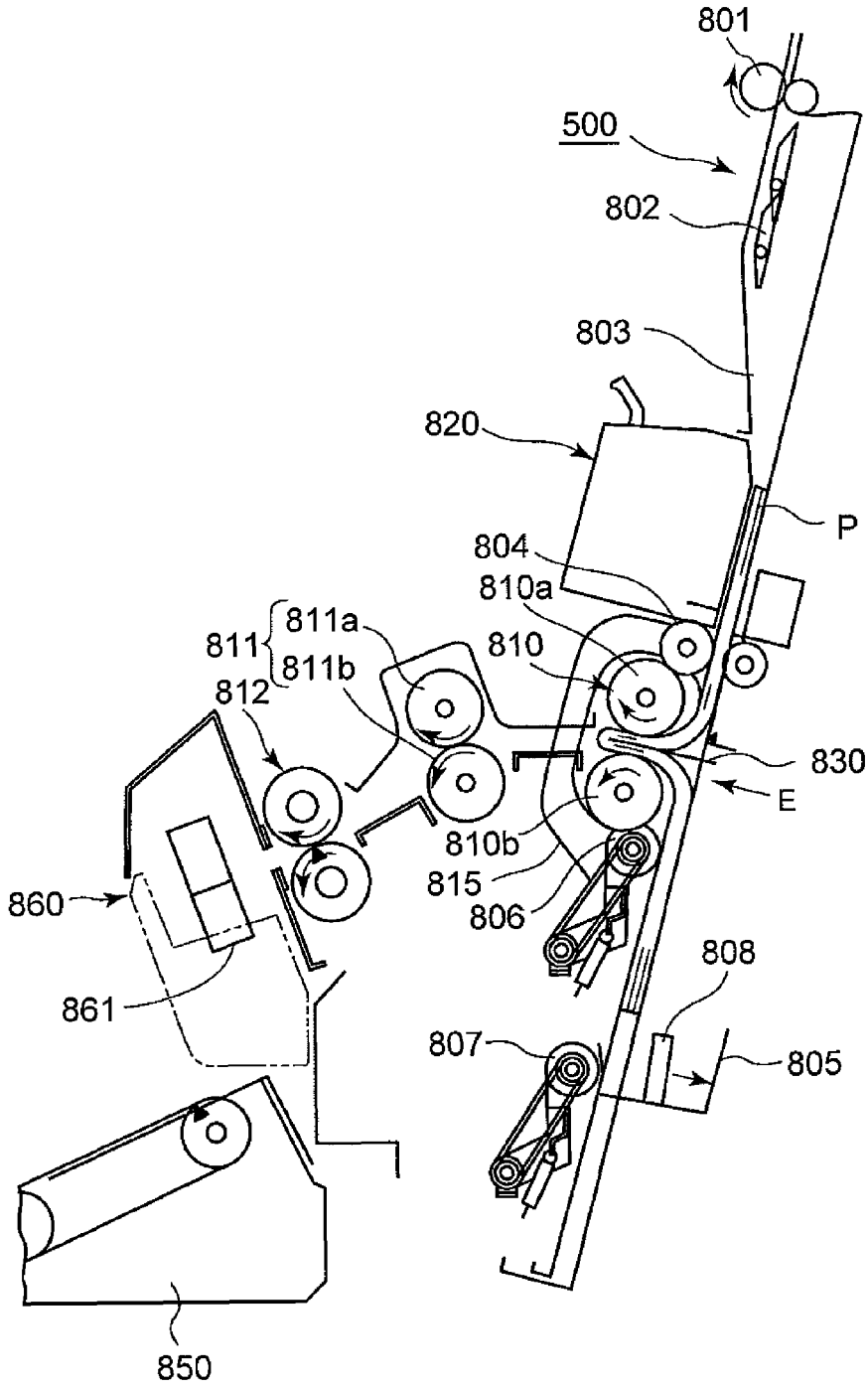
FIG. 12 is a view illustrating that a sheet bundle begins to be folded.

Then, as illustrated in FIG. 12, the protruding member 830 having been positioned at the home position starts to be moved toward the folding position, which corresponds to the nip between the pair of folding rollers 810 (810*a* and 810*b*), in a direction of an arrow E. Further, the middle portion of the sheet bundle P in the conveying direction is tucked into the nip between the pair of folding rollers 810, and is folded (S115). In this case, the pair of folding rollers 810, the pair of first folding conveyance rollers 811, and the pair of second folding conveyance rollers 812 are rotated by the driving of the conveying motor M4 (FIG. 1) in the directions of arrows.

While the folding line of the sheet bundle is set to the leading position, the sheet bundle (center-folded booklet bundle) P, which is folded in two by the pair of folding rollers 810, is conveyed toward the folding line pressing unit 860 by the pair of first folding conveyance rollers 811 and the pair of second folding conveyance rollers 812. Further, when the folding line of the sheet bundle is conveyed to a position where the sheet bundle is nipped by the pair of press rollers 861, the center-folded booklet bundle P is stopped by the conveying motor M4. Here, folding line processing is performed on the sheet bundle by the folding line pressing unit 860. The folding line processing is performed while the folding line pressing unit 860 having waited on one side (the back side of the apparatus) in the width direction is moved along the folding line of the sheet bundle toward the other side (the front side of the apparatus) in the width direction. The folding line of the sheet bundle is pressed by the pair of press rollers 861, so that the folding line is pressed (S116).

When the folding line processing of the folding line pressing unit 860 is finished and moved again to a standby position, the center-folded booklet bundle P, which has been stopped by the conveying motor M4, starts to be conveyed again and is discharged to the folded bundle discharge tray 850 by the pair of second folding conveyance rollers 812 (S117). The discharged center-folded booklet bundle P is stacked on the folded bundle discharge tray 850 that is positioned below the discharged center-folded booklet bundle. For the next sheet, the end stopper 805, which has been moved for the folding operation, is moved again to the receiving position.

The above-mentioned operations are repeatedly performed until a desired number of bundles are discharged onto the folded bundle discharge tray 850, and a job is then finished (S118).

As described above, the finisher 500 may switch the position of the end stopper 805 according to the stiffness (thickness) of a sheet. For this reason, if the stiffness of a sheet is high, the finisher 500 may stop the end stopper 805 at a position where the middle portion of the sheet in the conveying direction may face the binding position of the next process. Accordingly, it is possible to improve the alignment property of a sheet bundle. Further, if the stiffness of a sheet is low (a thin sheet), the finisher 500 stops the end stopper 805 at a position where buckling does not occur, that is, at any one of the upper and lower receiving positions. Accordingly, buckling occurring on a sheet is suppressed, and it is possible to improve the alignment property of a sheet bundle. Therefore, even in the case of a thin sheet, it is possible to improve the alignment property without limiting the size of a sheet. Further, the finisher 500 may produce a high-grade saddle stitching binding booklet.

Meanwhile, in the above description, if the end stopper 805 is stopped at the lower receiving position, when the lower feed roller 807 is conveying a sheet, the upper feed roller 806 is separated from the sheet and does not contribute to conveying the sheet without applying pressure to the sheet. However, the conveying operations of the upper and lower feed rollers 806 and 807 may be performed as follows. The conveying operations will be described with reference to FIGS. 13 to 17. Meanwhile, the same portions as those of the above-mentioned embodiment will be denoted by the same reference numerals, and the description thereof will not be repeated.

That is, if the end stopper 805 receives a sheet at the lower receiving position, the sheet may be temporarily conveyed by the upper and lower feed rollers 806 and 807.

When the end stopper 805 is stopped at the lower receiving position (FIG. 8), the distance between the sliding roller 804 and the lower feed roller 807 is longer than the case where the end stopper is stopped at the upper receiving position (FIG. 7). For this reason, in the case of a sheet having low rigidity (a thin sheet) or a bulky sheet (recycled paper and the like), buckling is apt to occur between the sliding roller 804 and the lower feed roller 807. As a result, an alignment property of the sheet may deteriorate.

Figure 13:
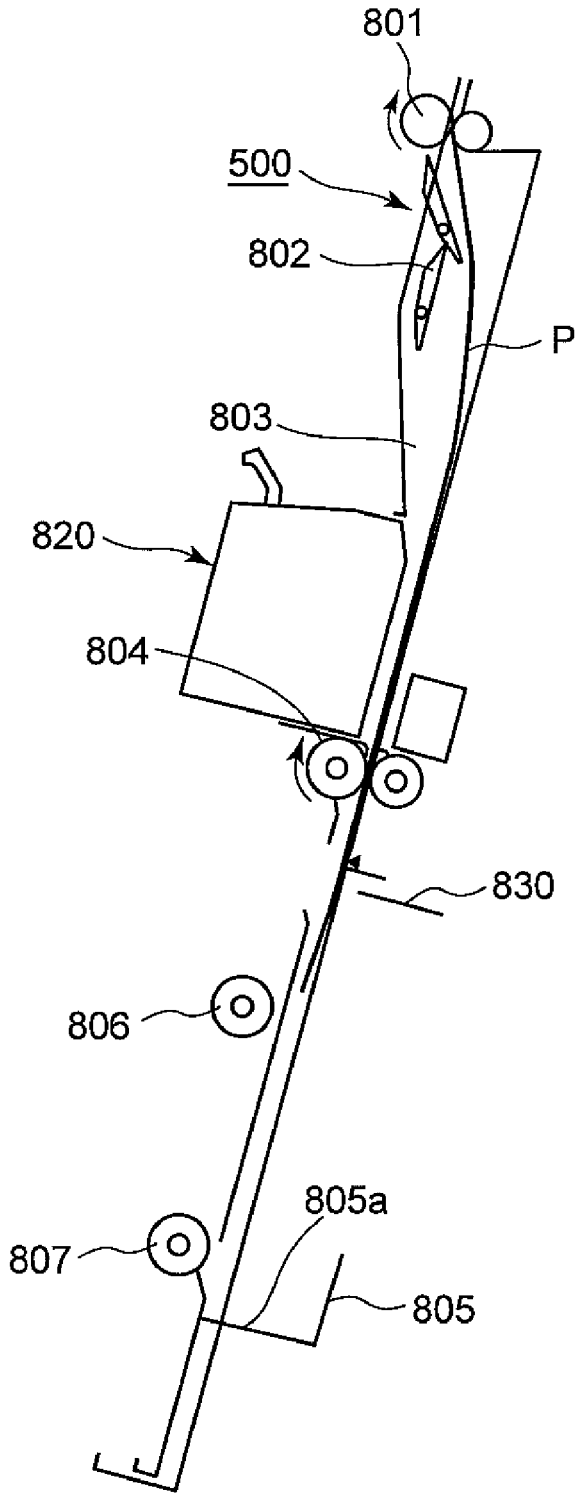
FIG. 13 is a view illustrating the conveying operation of the upper and lower feed rollers before a sheet is fed to the upper feed roller.
Figure 14:
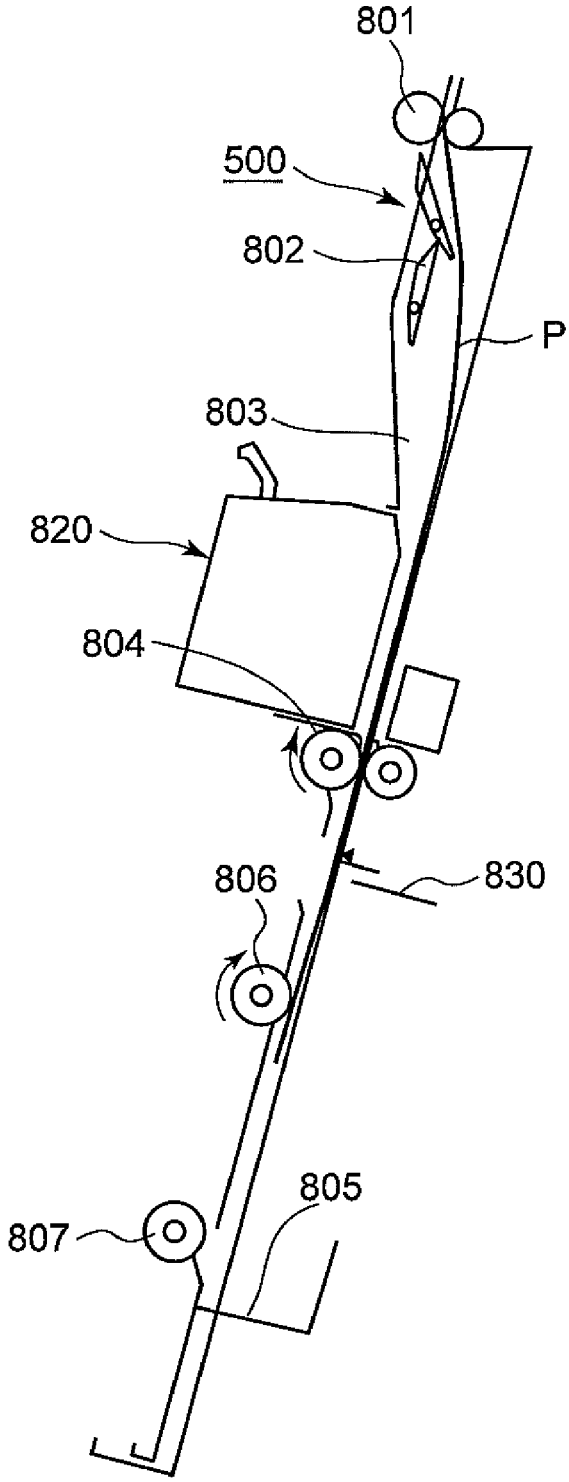
FIG. 14 is a view illustrating that a sheet is fed to the upper feed roller, following the state of FIG. 13.
Figure 15:
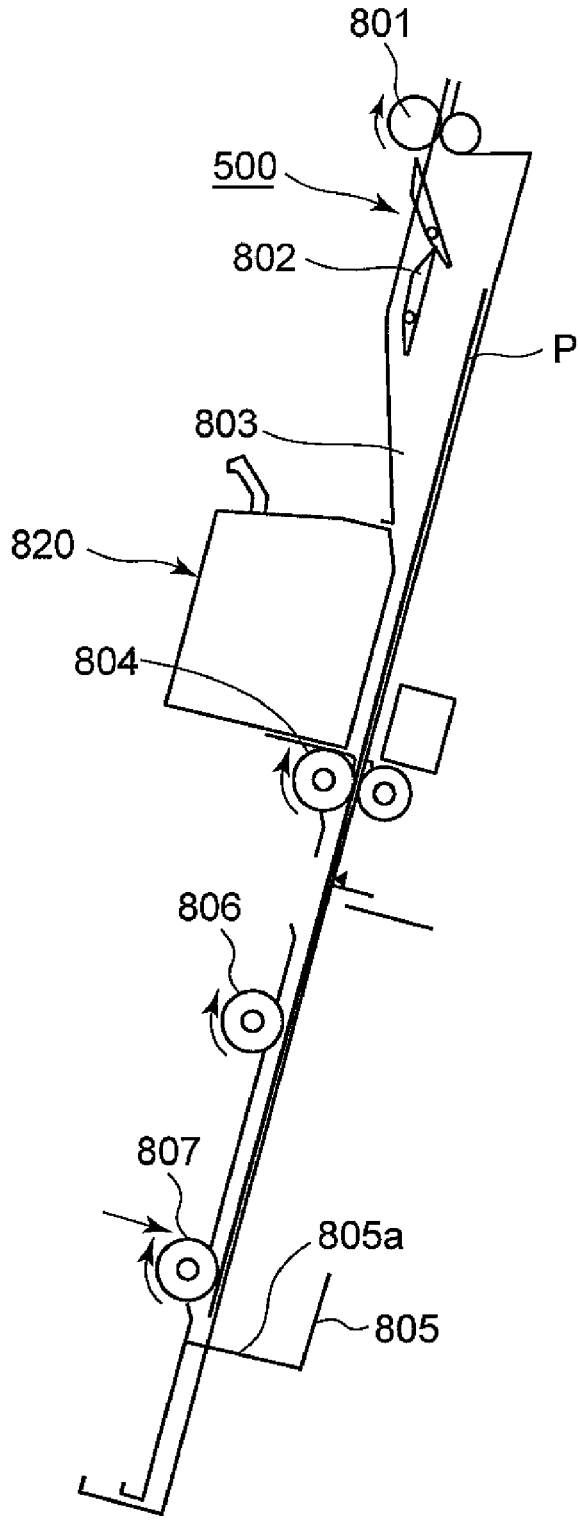
FIG. 15 is a view illustrating that a sheet is fed to the lower feed roller, following the state of FIG. 14.
Figure 16:
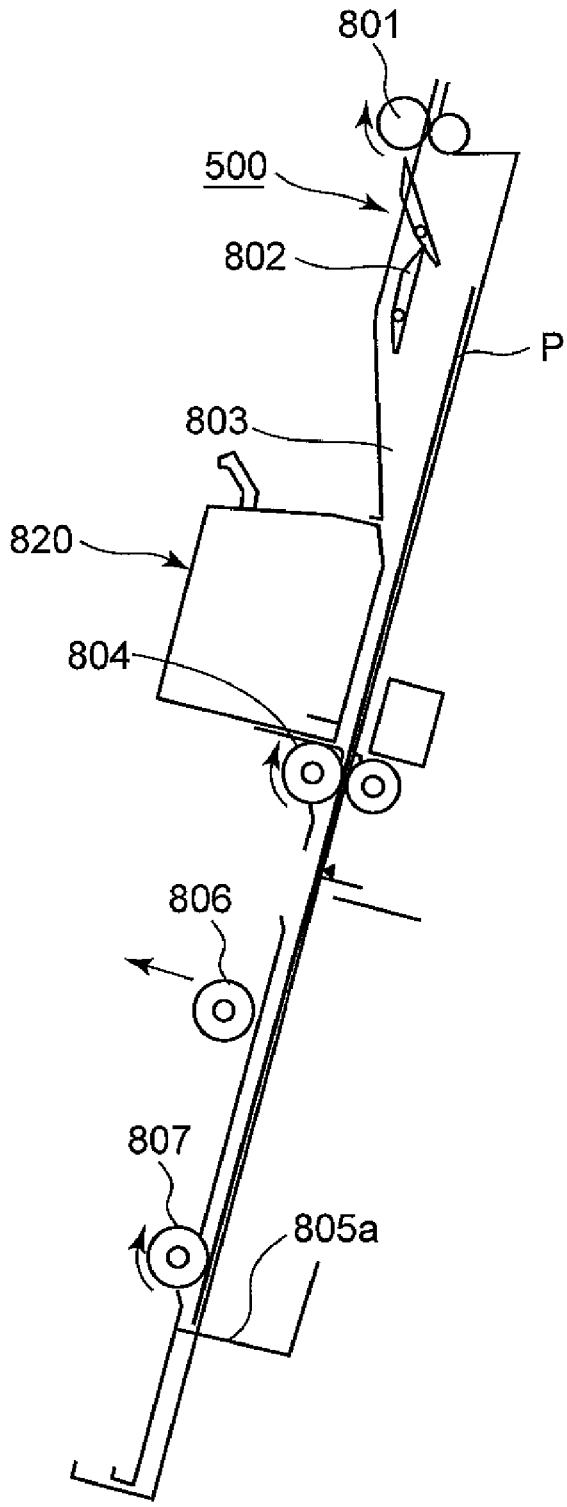
FIG. 16 is a view illustrating that the upper feed roller is separated from a sheet before a downstream end of the sheet reaches the end stopper, following the state of FIG. 15.

If a sheet is long or a sheet is thin and has low rigidity, the end stopper 805 may wait at the lower receiving position. In this case, after being discharged to the storage guide 803, the sheet P is conveyed to the vicinity of the upstream side of the upper feed roller 806 in the conveying direction while receiving a conveying force of the sliding roller 804 (FIG. 13). In this case, the upper and lower feed rollers 806 and 807 are rotated by the feed roller motor M6 (FIG. 1), and moved by solenoids (not illustrated) to the positions where the feed rollers do not abut against the sheet. Further, when the downstream end of the sheet P passes by the upper feed roller 806, the upper feed roller 806 presses the sheet P against the storage guide 803 and conveys the sheet (FIG. 14). After that, when the downstream end of the sheet P passes by the lower feed roller 807, the lower feed roller 807 presses the sheet P against the storage guide 803 and conveys the sheet (FIG. 15). Furthermore, before the downstream end of the sheet P reaches the end stopper 805, the upper feed roller 806 is separated form the sheet P and moved to the retraction position (FIG. 16). In this case, the upper feed roller 806 may be moved to the retraction position at the same time as the abutment of the lower feed roller 807. After that, the downstream end of the sheet P bumps into the end stopper 805, so that the sheet P is aligned in the sheet conveying direction. Further, the lower feed roller 807 is separated from the sheet (the pressure applied to the sheet is released) and moved to the retraction position. Subsequently, the gripping and alignment are performed by the pair of alignment plates 815 that has waited at a position having no difficulty in storing the sheet. Accordingly, the alignment is also performed in the width direction orthogonal to the sheet conveying direction. The above-mentioned operations for storing and aligning sheets are performed whenever one sheet P is discharged to the storage guide 803, and are performed until the alignment of the last sheet of one sheet bundle is finished. After that, the sheet bundle is bound, folded in two, and then discharged.

If the end stopper 805 receives a sheet at the lower receiving position as described above, the upper feed roller 806 may be used as a buckling prevention member. Accordingly, it is possible to prevent buckling or swelling, which is apt to occur on a sheet having low stiffness (a thin sheet) or a bulky sheet (recycled paper and the like), by the upper feed roller 806. As a result, the finisher 500 may improve the accuracy in aligning sheets by preventing the misalignment of the downstream ends of sheets.

Further, if the upper feed roller 806 retracts before abutting against the end stopper 805, it is possible to prevent buckling which might be caused by the excessive feed of the upper feed roller 806 that occurs between the upper and lower feed rollers 806 and 807.

Furthermore, if the conveying speed of the lower feed roller 807 is set to be slightly higher than that of the upper feed roller 806, the sheet is pulled so as not to be loosened. As a result, it is possible to prevent buckling from occurring.

Figure 17:
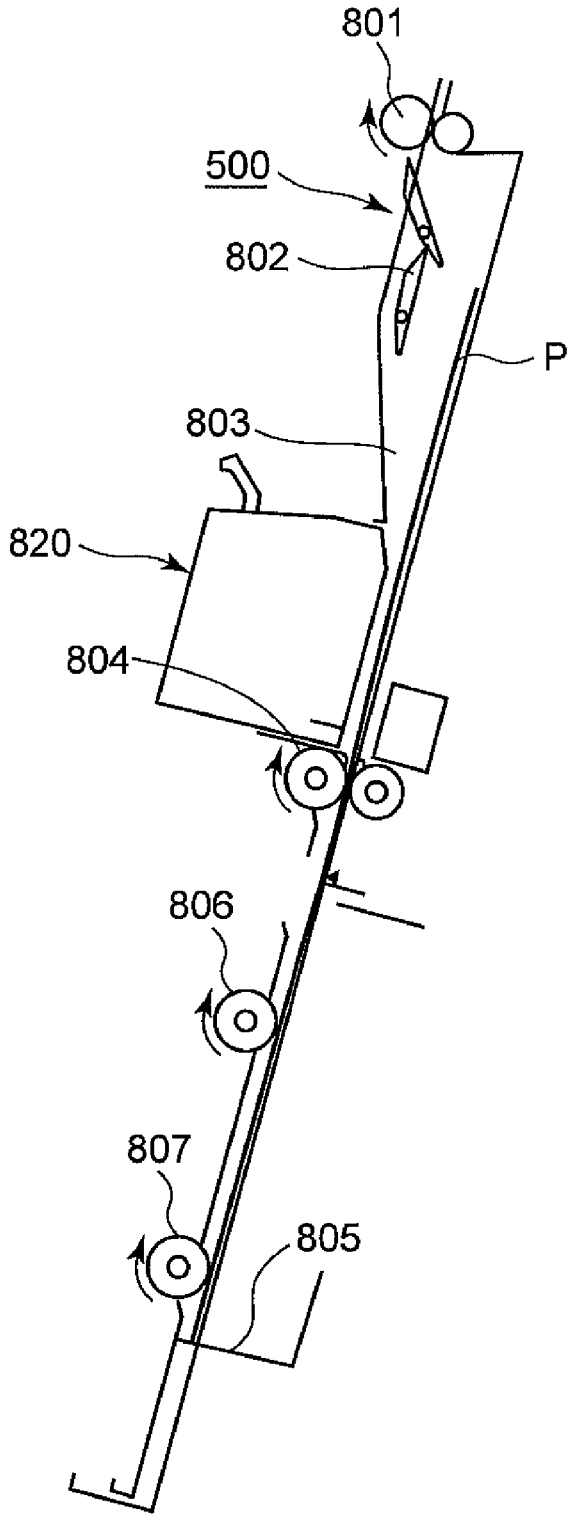
FIG. 17 is a view illustrating that the upper feed roller is rotated by a one-way clutch gear along with the conveyance of a sheet toward the downstream side.
Figure 18:
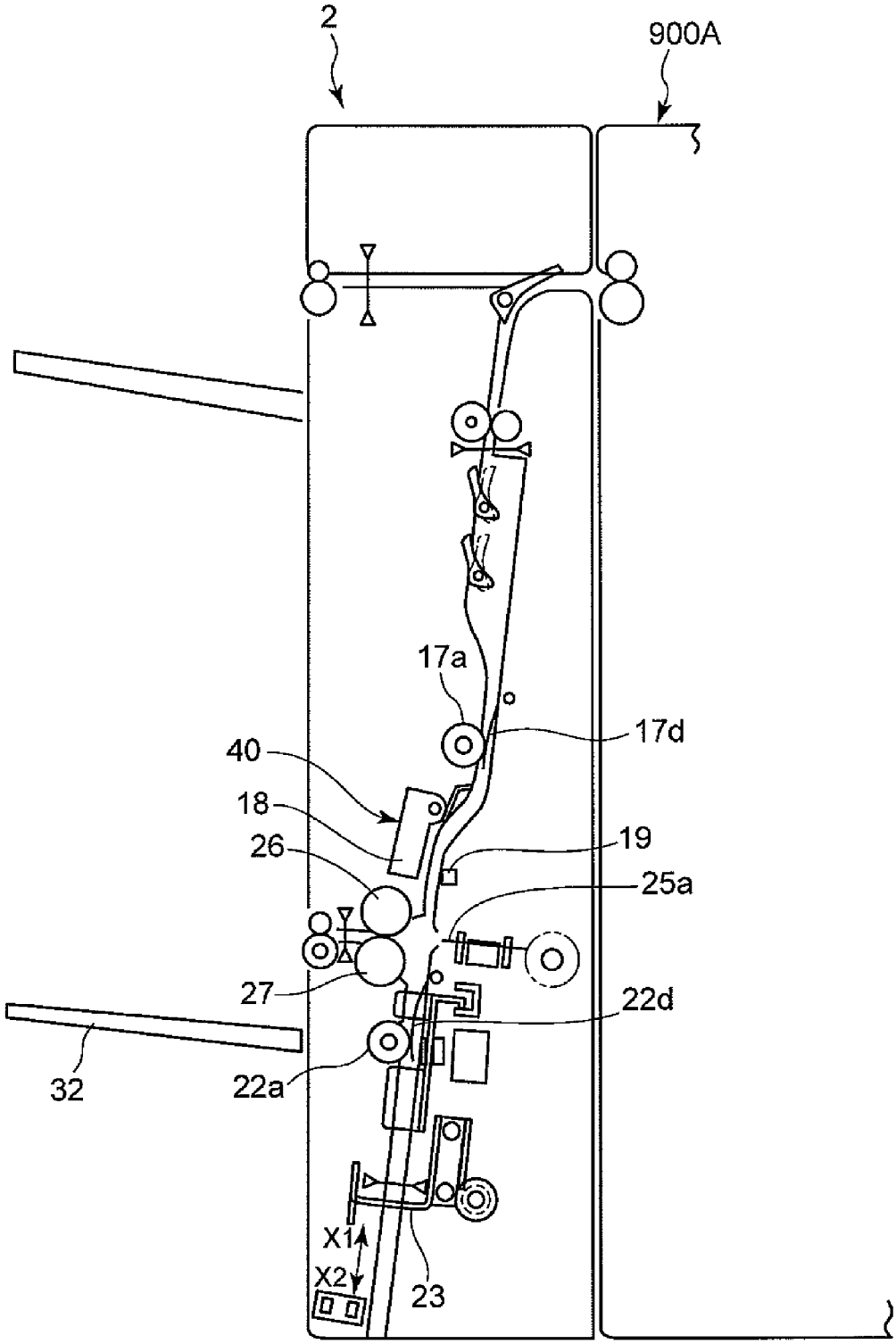
FIG. 18 PRIOR ART
FIG. 18 is a cross-sectional view of a sheet processing apparatus in the related art, taken along a sheet conveying direction.
Figure 19:
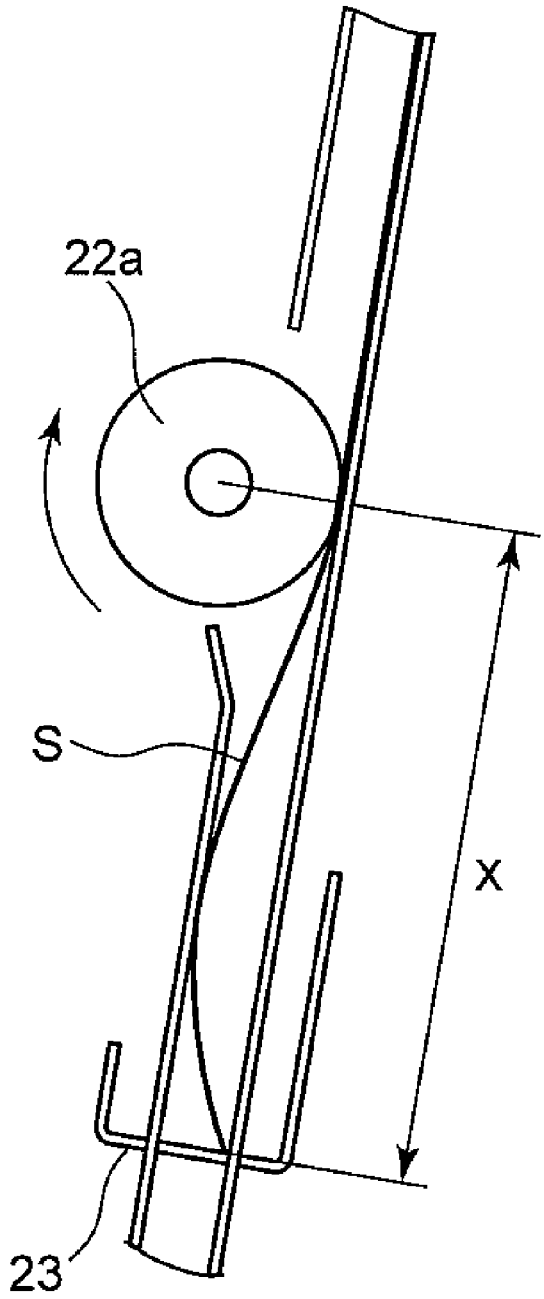
FIG. 19 PRIOR ART
FIG. 19 is a view illustrating that deflection occurs on a sheet in the sheet processing apparatus of FIG. 18.

Meanwhile, the upper and lower feed rollers 806 and 807 have been rotated by the common feed roller motor M6 (FIG. 1). However, the upper and lower feed rollers may be rotated by individual upper and lower feed roller motors (not illustrated), respectively. In this case, if the lower receiving position is selected as the receiving position of the end stopper 805, in order to improve the alignment property of a sheet having low stiffness (a thin sheet), the upper and lower feed rollers 806 and 807 may be rotated as follows:

After the end stopper 805 is moved to the lower receiving position, the sheet P is conveyed to the vicinity of the upstream side of the upper feed roller 806 in the conveying direction while receiving a conveying force of the sliding roller 804. In this case, the upper and lower feed rollers 806 and 807 are positioned at the positions where the feed rollers do not abut against the sheet. Further, when the downstream end of the sheet P passes by the upper feed roller 806, the upper feed roller 806 is rotated by the upper feed roller motor, presses the sheet P against the storage guide 803 by the solenoid 816*a* (FIG. 3), and conveys the sheet P. After that, when the downstream end of the sheet P passes by the lower feed roller 807, the lower feed roller 807 is rotated by the lower feed roller motor, presses the sheet P against the storage guide 803 by the solenoid 816*b* (FIG. 3), and conveys the sheet P. Furthermore, before the downstream end of the sheet P reaches the end stopper 805, the upper feed roller 806 is stopped. In this case, the upper feed roller 806 is rotated by the one-way clutch gear 806*b*, which is assembled on the fulcrum shaft 806*c* of the upper feed roller 806 illustrated in FIG. 3, so as to be rotated along with the conveyance of the sheet to the downstream side (FIG. 17).

Meanwhile, the rotation of the upper feed roller 806 may be stopped at the same time as the abutment of the lower feed roller 807 against the sheet. Further, without the stop of the rotation of the upper feed roller 806, the rotating speed of the upper feed roller motor may be reduced and the conveying speed of the upper feed roller 806 may be set to be lower than that of the lower feed roller 807.

After that, the downstream end of the sheet P bumps into the end stopper 805, so that the sheet is aligned in the sheet conveying direction. Then, the upper and lower feed rollers 806 and 807 are moved to the retraction positions. The subsequent operations are the same as described above.

If the upper feed roller 806 is rotated along with the sheet that is moved to the downstream side or the sheet conveying speed of the upper feed roller 806 is lower than that of the lower feed roller 807 as described above, the swelled sheet is pulled. As a result, it is possible to obtain an advantage of extending the sheet. Further, until the downstream end of the sheet P bumps into the end stopper 805, the upper feed roller 806 may be kept abutting against the sheet. Accordingly, the upper feed roller 806 functions as a buckling prevention member, and may prevent the buckling of the sheet during the conveyance of the sheet. In addition, since the upper feed roller 806 is rotated even after the downstream end of the sheet P reaches the end stopper 805, it is possible to prevent the buckling of a sheet caused by the excessive feed that occurs between the upper and lower feed rollers 806 and 807. Accordingly, the finisher 500 may improve the alignment property of a sheet. As a result, it is possible to obtain a high-grade saddle stitching binding booklet of which the edges of sheets are aligned.

Meanwhile, in the above description, the saddle stitching binding portion 800 has been described as a processing portion that is provided above the upper and lower feed rollers 806 and 807 and processes the portion (to be processed) of the sheet lifted or lowered by the end stopper 805. The saddle stitching binding portion 800 includes the stapler (binding unit) 820 and the folding device that includes the pair of folding rollers 810 and the protruding member 830. However, the processing portion may be one of the stapler (binding unit) 820 and the folding device that includes the pair of folding rollers 810 and the protruding member 830.

Further, both the binding unit and the folding device as the processing portion perform saddle stitching that binds the middle portions of the sheets in the conveying direction at a predetermined binding position, or center-folding that folds the middle portions in two at a predetermined folding position. However, the invention is not limited thereto. The positions on the sheet, on which processing is to be performed at a predetermined binding position for the stapler or a predetermined folding position for the folding device, may be appropriately set as necessary. Accordingly, the distance between the end of the sheet and the position on the sheet, on which processing is to be performed, is also not limited to half the length of the sheet in the conveying direction. Further, in the above-mentioned embodiment, the binding position for the stapler and the folding position for the folding device have been different from each other in the sheet conveying direction but may be the same processing position. In this case, the time required to process the sheet is further reduced.

Furthermore, the upper and lower (two) feed rollers 806 and 807 have been exemplified as the conveying portion. However, a plurality of feed rollers may be arranged along the sheet conveying direction in a vertical direction, the number of feed rollers is not limited to two, and three or more feed rollers may be arranged.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-020828, filed Jan. 30, 2009, and No. 2010-009863, filed Jan. 20, 2010, which are hereby incorporated by reference herein in their entirety.

What is claimed is:

1. A sheet processing apparatus comprising:

a conveying portion that conveys a sheet; and an abutment member against which an end of the sheet conveyed by the conveying portion in a conveying direction abuts, and is movable along the conveying direction; and a controller which controls a movement of the abutment member so that the abutment member is moved so as to reduce a distance between the abutment member and the conveying portion adjacent to the abutment member, based on sheet information that a stiffness of a sheet to be conveyed is lower than a predetermined stiffness.

2. A sheet processing apparatus comprising:

a conveying portion that conveys a sheet;

an abutment member against which an end of the sheet conveyed by the conveying portion in a conveying direction abuts, and is movable along the conveying direction;

a processing portion that processes the sheet of which an end in the conveying direction is abutted against the abutment member; and a controller which controls a position of the abutment member so that the abutment member is selectively movable to one of first and second positions, wherein the first position corresponds to a processing position of the processing portion, a distance between the abutment member and the conveying portion adjacent to the abutment member is short at the second position in comparison with the first position, and the controller controls the position of the abutment member so that the abutment member is moved to the second position, based on sheet information that a stiffness of a sheet to be conveyed is lower than a predetermined stiffness.

3. The sheet processing apparatus according to claim 2, wherein after the end of the sheet abuts against the abutment member at the second position, the controller controls the position of the abutment member so that the abutment member is moved to the first position.

4. The sheet processing apparatus according to claim 2, wherein the abutment member includes a grip part that grips the sheet abutted against the abutment member.

5. The sheet processing apparatus according to claim 2, wherein the conveying portion includes a plurality of conveying rollers that is arranged in a sheet conveying direction, the first position is set according to a length of the sheet to be processed by the processing portion, a plurality of second positions are separated from the plurality of conveying rollers respectively toward downstream in the sheet conveying direction by predetermined distances, and the controller controls the position of the abutment member so that the abutment member is selectively movable to one of the first position and the second position that is closest to the first position among the plurality of second positions.

6. The sheet processing apparatus according to claim 5, wherein when the first position, based on information about the length of a sheet, is positioned within a range of a predetermined distance on downstream of one conveying roller of the plurality of conveying rollers in the sheet conveying direction, the controller controls so that the abutment member receives the end of a sheet at the first position even though the sheet information indicates that the stiffness of the sheet is lower than the predetermined stiffness.

7. The sheet processing apparatus according to claim 5, wherein the sheet conveying speed of one conveying roller, which is provided on downstream in the sheet conveying direction, is higher than that of another conveying roller, which is provided on upstream in the sheet conveying direction.

8. The sheet processing apparatus according to claim 5, wherein when conveying a sheet toward downstream in the sheet conveying direction, the plurality of conveying rollers convey a sheet by operations for pressing the sheet and releasing the sheet sequentially from the upstream conveying roller.

9. The sheet processing apparatus according to claim 8, wherein among the plurality of conveying rollers, one conveying roller which is provided on upstream in the sheet conveying direction is apt to slide on the sheet in comparison with another conveying roller which is provided on downstream in the sheet conveying direction.

10. The sheet processing apparatus according to claim 8, wherein one conveying roller, which is provided on an upstream side in the sheet conveying direction, includes a clutch rotated along with the sheet that is conveyed by another conveying roller provided on a downstream side.

11. An image forming apparatus comprising:

an apparatus main body;

an image forming portion that is provided in the apparatus main body and forms an image on a sheet; and a sheet processing apparatus that processes the sheet on which the image has been formed by the image forming portion, the sheet processing apparatus includes:

a conveying portion that conveys a sheet;

an abutment member against which an end of the sheet conveyed by the conveying portion in a conveying direction abuts, and is movable along the conveying direction; and a controller which controls a movement of the abutment member so that wherein the abutment member is moved so as to reduce a distance between the abutment member and the conveying portion adjacent to the abutment member, based on sheet information that stiffness of a sheet to be conveyed is lower than a predetermined stiffness.

12. An image forming apparatus comprising:

an apparatus main body;

an image forming portion that is provided in the apparatus main body and forms an image on a sheet; and a sheet processing apparatus that processes the sheet on which the image has been formed by the image forming portion, the sheet processing apparatus includes:

a conveying portion that conveys a sheet;

an abutment member against which an end of the sheet conveyed by the conveying portion in a conveying direction abuts, and is movable along the conveying direction;

a processing portion that processes the sheet of which an end in the conveying direction is abutted against the abutment member; and a controller which controls a position of the abutment member so that the abutment member is selectively movable to one of first and second positions, wherein the first position corresponds to a processing position of the processing portion, a distance between the abutment member and the conveying portion adjacent to the abutment member is short at the second position in comparison with the first position, and the controller controls the position of the abutment member so that the abutment member is moved to the second position, based on sheet information that a stiffness of a sheet to be conveyed is lower than a predetermined stiffness.

13. The image forming apparatus according to claim 12, wherein after the end of the sheet abuts against the abutment member at the second position, the controller controls the position of the abutment member so that the abutment member is moved to the first position.

14. The image forming apparatus according to claim 12, wherein the abutment member includes a grip part that grips the sheet abutted against the abutment member.

15. The image forming apparatus according to claim 12, wherein the conveying portion includes a plurality of conveying rollers that is arranged in a sheet conveying direction, the first position is set according to a length of the sheet to be processed by the processing portion, a plurality of second positions are separated from the plurality of conveying rollers respectively toward downstream in the sheet conveying direction by predetermined distances, and the controller controls the position of the abutment member so that the abutment member is selectively movable to one of the first position and the second position that is closest to the first position among the plurality of second positions.

16. The image forming apparatus according to claim 15, wherein when the first position, based on information about the length of a sheet, is positioned within a range of a predetermined distance on downstream of one conveying roller of the plurality of conveying rollers in the sheet conveying direction, the controller controls so that the abutment member receives the end of a sheet at the first position even though the sheet information indicates that the stiffness of the sheet is lower than the predetermined stiffness.

17. The image forming apparatus according to claim 15, wherein the sheet conveying speed of one conveying roller, which is provided on downstream in the sheet conveying direction, is higher than that of another conveying roller, which is provided on upstream in the sheet conveying direction.

18. The image forming apparatus according to claim 15, wherein when conveying a sheet toward downstream in the sheet conveying direction, the plurality of conveying rollers convey a sheet by operations for pressing the sheet and releasing the sheet sequentially from the upstream conveying roller.

19. The image forming apparatus according to claim 15, wherein among the plurality of conveying rollers, one conveying roller which is provided on upstream in the sheet conveying direction is apt to slide on the sheet in comparison with another conveying roller which is provided on downstream in the sheet conveying direction.

20. The image forming apparatus according to claim 15, wherein one conveying roller, which is provided on upstream in the sheet conveying direction, includes a clutch rotated along with the sheet that is conveyed by another conveying roller provided on downstream.

* * * * *